US011644279B2

(12) United States Patent
Jackson

(10) Patent No.: US 11,644,279 B2
(45) Date of Patent: May 9, 2023

(54) SYSTEMS AND METHODS FOR SIMULATED RIFLE ROUNDS

(71) Applicant: EPIC MFG LLC, Virginia Beach, VA (US)

(72) Inventor: Jason D. Jackson, Virginia Beach, VA (US)

(73) Assignee: EPIC MFG LLC, Chesapeake, VA (US)

( * ) Notice: Subject to any disclaimer, the term of this patent is extended or adjusted under 35 U.S.C. 154(b) by 210 days.

(21) Appl. No.: 17/110,840

(22) Filed: Dec. 3, 2020

(65) Prior Publication Data

US 2021/0172707 A1 Jun. 10, 2021

Related U.S. Application Data

(60) Provisional application No. 62/943,711, filed on Dec. 4, 2019.

(51) Int. Cl.
*F41G 3/26* (2006.01)
*F41A 33/02* (2006.01)

(52) U.S. Cl.
CPC ..... *F41G 3/2655* (2013.01); *F41A 33/02* (2013.01)

(58) Field of Classification Search
USPC ..... 434/16, 18, 19, 21
See application file for complete search history.

(56) References Cited

U.S. PATENT DOCUMENTS

| | | | | |
|---|---|---|---|---|
| 4,019,262 | A * | 4/1977 | Breglia | F41G 3/2627 434/21 |
| 8,919,025 | B2 | 12/2014 | Kuczynko | |
| 9,228,799 | B2 | 1/2016 | Kuczynko | |
| 9,234,717 | B2 | 1/2016 | Jarboe | |
| 10,801,804 | B2 * | 10/2020 | Sandgren | F41B 11/721 |
| 2007/0033851 | A1 | 2/2007 | Hochstrate et al. | |
| 2012/0017483 | A1 | 1/2012 | Vuksanovich | |
| 2014/0076152 | A1 | 3/2014 | Hochstrate et al. | |
| 2016/0010937 | A1 | 1/2016 | Bero | |

FOREIGN PATENT DOCUMENTS

| | | | | |
|---|---|---|---|---|
| KR | 20160029559 A * | 3/2016 | | F41A 33/06 |
| KR | 101698116 B1 * | 3/2017 | | F41A 33/06 |

* cited by examiner

*Primary Examiner* — Reginald S Tillman, Jr.
(74) *Attorney, Agent, or Firm* — Ambrose, Mills & Lazarow, PLLC

(57) ABSTRACT

An apparatus includes a bolt carrier assembly and a bolt assembly. The bolt assembly includes a bolt body member, the bolt body member having a proximal end portion and a distal end portion, and defining a longitudinal axis extending from the proximal end to the distal end. The bolt assembly includes a guide member attached to proximal end portion and the guide member is parallel to the longitudinal axis. The bolt assembly further includes a bolt chamber interface attached to a distal end portion, the bolt chamber interface nests within an interior wall of a firearm chamber, and the bolt chamber interface limits rotational and axial movement of the bolt assembly relative to the firearm chamber. The bolt assembly includes a bolt nipple connector for mating with a nipple assembly of a magazine assembly.

20 Claims, 19 Drawing Sheets

SYSTEMS AND METHODS FOR SIMULATED RIFLE ROUNDS

RELATED APPLICATIONS

This application claims priority to and the benefit of U.S. Patent Application No. 62/943,711, filed Dec. 4, 2019, entitled "SYSTEMS AND METHODS FOR SIMULATED RIFLE ROUNDS", which is incorporated herein by reference in its entirety.

BACKGROUND

The embodiments described herein relate to components for converting a firearm to fire simulated rounds, and more particularly, a drop-in trainer bolt and magazine system to convert a firearm to simulate recoil and interact with a target hit detection system.

Known replica weapons for training, such as airsoft guns, are typically modeled after firearms used by law enforcement or military personnel. In particular, airsoft guns are designed to look like its counterpart firearm and provide some degree of tactile feedback when operated. Airsoft guns in the related art operate on a low-powered platform and are designed to shoot non-metallic projectiles that have less penetrative and stopping powers than conventional ammunition. For example, airsoft guns generally have a low muzzle energy rating of between about 1.0-1.5 Joules (or about 0.74 to 1.10 ft-lb). While the low muzzle energy of the airsoft guns provide a small amount of recoil feedback, the tactile feedback is not on par with the recoil feedback experienced with an actual corresponding firearm. Furthermore, while airsoft guns mimic the overall look and feel of the actual corresponding firearm, the materials and weight of the airsoft gun are also not the same as the actual firearm. For example, it may be cost prohibitive to produce airsoft guns to "MIL-SPEC" standards in large quantities solely for training purposes.

Thus, a need exists for an improved training weapon system that more realistically replicates operating conditions of an actual firearm without the use of live or frangible rounds.

SUMMARY

A training weapon system and methods for replicating live rounds and interacting with a target hit detection system are described herein. In some embodiments, an apparatus includes a bolt carrier assembly and a bolt assembly. The bolt assembly includes a bolt body member, the bolt body member having a proximal end portion and a distal end portion, and the bolt body member defining a longitudinal axis extending from the proximal end to the distal end. The bolt assembly includes a guide member attached to the proximal end portion, the guide member being parallel to the longitudinal axis. The bolt assembly includes a bolt chamber interface attached to a distal end portion, the bolt chamber interface being configured to nest within an interior wall of a firearm barrel, and the bolt chamber interface being configured to limit rotational and axial movement of the bolt assembly relative to the firearm barrel. The bolt assembly includes a bolt nipple connector for mating with a nipple assembly of a magazine assembly. The bolt carrier assembly includes a bolt carrier body and a guide member receiver extending through at least a portion of the bolt carrier body. The bolt carrier body is configured to slide relative to the bolt assembly, the bolt carrier body being slidable along the guide member via the guide member receiver in a direction parallel to the longitudinal axis.

DETAILED DESCRIPTION

Figure 1:
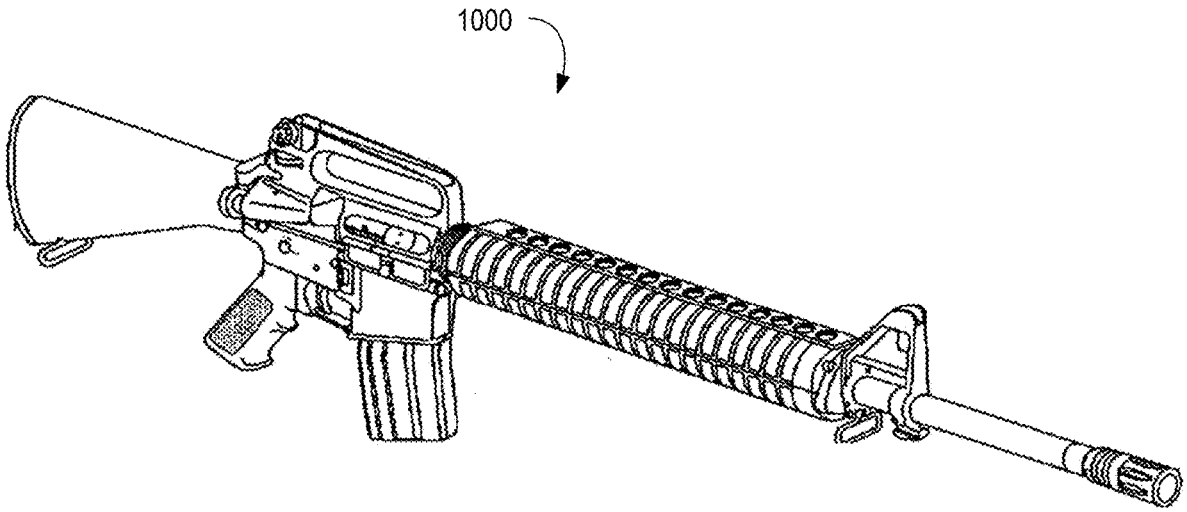
FIG. 1 (Prior Art)
FIG. 1 is side perspective view of an assembled AR-15 rifle in the related art.

A training weapon system and methods for replicating live rounds and interacting with a target hit detection system are described herein. In some embodiments, an apparatus includes a bolt carrier assembly and a bolt assembly. The bolt assembly includes a bolt body member, the bolt body member having a proximal end portion and a distal end portion, and the bolt body member defining a longitudinal axis extending from the proximal end to the distal end. The bolt assembly includes a guide member attached to the proximal end portion, the guide member being parallel to the longitudinal axis. The bolt assembly includes a bolt chamber interface attached to a distal end portion, the bolt chamber interface being configured to nest within an interior wall of a firearm barrel, and the bolt chamber interface being configured to limit rotational and axial movement of the bolt assembly relative to the firearm barrel. In some embodiments, the bolt assembly includes a bolt nipple connector for mating with a nipple assembly of a magazine assembly. In some embodiments, the bolt body member defines an interior volume for retaining pressurized gas. The interior volume is configured to receive pressurized gas from the magazine assembly via the bolt nipple connector. In some embodiments, the bolt assembly includes a balanced core seal member, and the balance core seal member is configured to actuate to release pressurized gas from the interior volume of the bolt body. The bolt carrier assembly includes a bolt carrier body and a guide member receiver extending through at least a portion of the bolt carrier body. The bolt carrier body is configured to slide relative to the bolt assembly, the bolt carrier body being slidable along the guide member via the guide member receiver in a direction parallel to the longitudinal axis. In some embodiments, the apparatus includes a magazine assembly. The magazine assembly includes a nipple assembly. The nipple assembly includes a proximal portion and a distal portion. The distal portion includes a recess configured to retain a sealing member, the sealing member extending radially inward relative to the nipple assembly. In some embodiments, the sealing member includes a first seal element and a second seal element, the first seal member at least partially surrounding the second seal element. In some embodiments, the first seal element is a U-shaped or a C-shaped member. In some embodiments, the proximal portion includes a recess configured to retain a second sealing member, the sealing member extending radially outward relative to the nipple assembly.

In some embodiments, the apparatus includes a target hit detection system. In some embodiments, the target hit detection system is a laser targeting system. The laser targeting system includes a laser body, the laser body having a proximal end portion and a distal end portion. The laser targeting system includes a laser output at the distal end portion. The laser targeting system includes a switch at the proximal end portion. In some embodiments, the bolt assembly includes a buffer spring member and an actuator pin. The actuator pin is configured to depress the switch of the laser targeting system when actuated.

In some embodiments, an apparatus includes a bolt assembly and a target system mount coupled to the bolt assembly. The bolt assembly includes a bolt body member with a proximal end portion and a distal end portion. The bolt body member defines a longitudinal axis extending from the proximal end portion to the distal end portion. The bolt assembly includes a bolt chamber interface attached to a distal end portion. The bolt chamber interface is configured to nest within an interior wall of a firearm chamber. The bolt chamber interface is configured to limit rotational and axial movement of the bolt assembly relative to the firearm chamber. The target system mount is configured to secure a laser targeting system to the distal end portion of the bolt body member. In some embodiments, the target system mount is a grommet including a first annular lip and a second annular lip. The first annular lip and the second annular lip are spaced axially apart along a longitudinal axis of the grommet. The first annular lip and the second annular lip are configured to interlock with the distal end portion of the bolt body member. In some embodiments, the target system mount is a cap including an outer surface and an end stop portion. The end stop portion is configured to abut against the distal end portion of the bolt body member while the outer surface is inserted within the distal end portion of the bolt body member. In some embodiments, the bolt chamber interface includes a plurality of bolt lugs dimensioned to interlock with corresponding lugs of a firearm barrel.

In some embodiments, a method of installing a training weapon system includes coupling a target hit detection system to a bolt assembly. The method further includes inserting a bolt assembly into a barrel assembly of a rifle. The method includes rotating the bolt assembly relative to the barrel assembly of the rifle to lock the bolt assembly within the barrel assembly. In some embodiments, the rotating can be performed manually by hand without any tools. The method includes coupling the upper assembly to the lower assembly of the rifle. The method includes coupling the magazine assembly to the bolt assembly. In some embodiments, the coupling of the magazine assembly to the bolt assembly includes aligning the nipple assembly of the magazine assembly with the bolt nipple connector of the bolt assembly. In some embodiment, the coupling of the magazine assembly to the bolt assembly further includes inserting the nipple assembly over the bolt nipple connector. In some embodiments, the coupling of the magazine assembly to the bolt assembly further includes centering a valve actuator pin relative to the bolt nipple connector. In some embodiments, the coupling of the magazine assembly to the bolt assembly includes depressing the valve actuator pin to release a pressurized gas from the magazine assembly into the bolt assembly upon completion of the attachment of the magazine assembly to the bolt assembly.

In some embodiments, a method of generating a simulated round in a firearm using a training weapon system includes conveying, via a bolt nipple connecting, pressurized gas into an interior volume of a bolt assembly. The interior volume is fluidically sealed by at least a balanced core seal member. The method includes actuating a balanced core to unseat the balanced core seal member and to release pressurized gas from the interior volume of the bolt assembly. The method further includes conveying the released pressurized gas to a bolt carrier body. The method includes actuating the bolt carrier body in response to a force applied by the released pressurized gas applied to the bolt carrier body. The actuation of the bolt carrier body causes the bolt carrier body to move away from a home position, and the actuation of the bolt carrier body generates a simulated recoil effect. In some embodiments, the method includes actuating the balanced coil to seat the balanced core seal member and to fluidically seal the interior volume of the bolt assembly. In some embodiments, the method includes actuating the bolt carrier body, via force from an action spring, to return to the home position.

In some embodiments, the conveying the pressurized gas into the interior volume includes pressurizing the interior volume of the bolt assembly to a pressure of between about 3102.6 kPa (450 psi) to 4136.9 kPa (600 psi). In some embodiments, the method includes actuating, via force from a century spring member, the balanced core to seat that balanced core seal member and to seal the interior volume of the bolt assembly. In some embodiments, the method includes actuating a switch of the laser targeting system to transmit a signal representative of a simulated round being fired.

The term "about" when used in connection with a referenced numeric indication means the referenced numeric indication plus or minus up to 10 percent of that referenced numeric indication. For example, "about 100" means from 90 to 110.

As used in this specification and the appended claims, the words "proximal" and "distal" refer to direction closer to and away from, respectively, an operator of the firearm. Thus, for example, the end of the firearm or firearm component nearest the operator during a firing operation would be the proximal end of the component, while the end opposite the proximal end would be the distal end of the component. For example, a proximal end of a rifle barrel would be the end portion that is coupled to the receiver, and the distal end would be end out of which the ammunition is expelled. Although a rifle is shown and described with reference to the figures, the training weapon system can be used with various types of firearms, including but not limited to. pistols, shotguns, machine guns, and carbines. Additionally, the training weapon system can be used with automatic and semi-automatic firearms.

The term "parallel" is used herein to describe a relationship between two geometric constructions (e.g., two lines, two planes, a line and a plane, or the like) in which the two geometric constructions are non-intersecting as they extend substantially to infinity. For example, as used herein, a planar surface (i.e., a two-dimensional surface) is said to be parallel to a line when every point along the line is spaced apart from the nearest portion of the surface by a substantially equal distance. Similarly, a first line (or axis) is said to be parallel to a second line (or axis) when the first line and the second line do not intersect as they extend to infinity. Two geometric constructions are described herein as being "parallel" or "substantially parallel" to each other when they are nominally parallel to each other, such as for example, when they are parallel to each other within a tolerance. Such tolerances can include, for example, manufacturing tolerances, measurement tolerances or the like.

The terms "perpendicular," "orthogonal," and "normal" are used herein to describe a relationship between two geometric constructions (e.g., two lines, two planes, a line and a plane, or the like) in which the two geometric constructions intersect at an angle of approximately 90 degrees within at least one plane. For example, as used herein, a line (or axis) is said to be normal to a planar surface when the line and a portion of the planar surface intersect at an angle of approximately 90 degrees within the planar surface. Two geometric constructions are described herein as being, for example, "perpendicular" or "substantially perpendicular" to each other when they are nominally perpendicular to each other, such as for example, when they are perpendicular to each other within a tolerance. Such tolerances can include, for example, manufacturing tolerances, measurement tolerances or the like.

Similarly, geometric terms, such as "parallel," "perpendicular," "cylindrical," "square," "conical," or "frusto-conical" are not intended to require absolute mathematical precision, unless the context indicates otherwise. Instead, such geometric terms allow for variations due to manufacturing or equivalent functions. For example, if an element is described as "conical" or "generally conical," a component that is not precisely conical (e.g., one that is slightly oblong) is still encompassed by this description.

Figure 2:
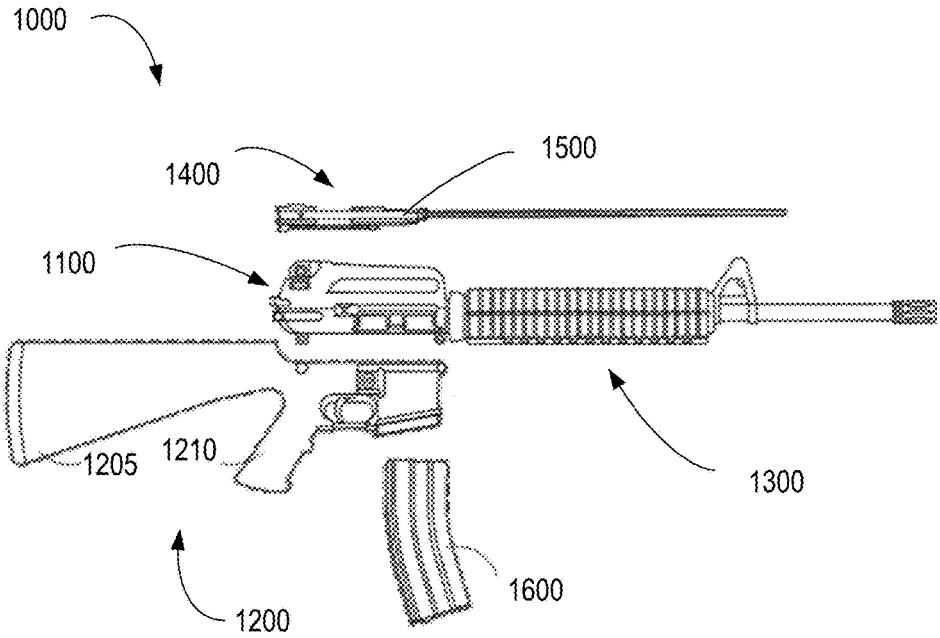
FIG. 2 (Prior Art)
FIG. 2 is a side view of a partially disassembled AR-15 rifle in the related art.
Figure 3:
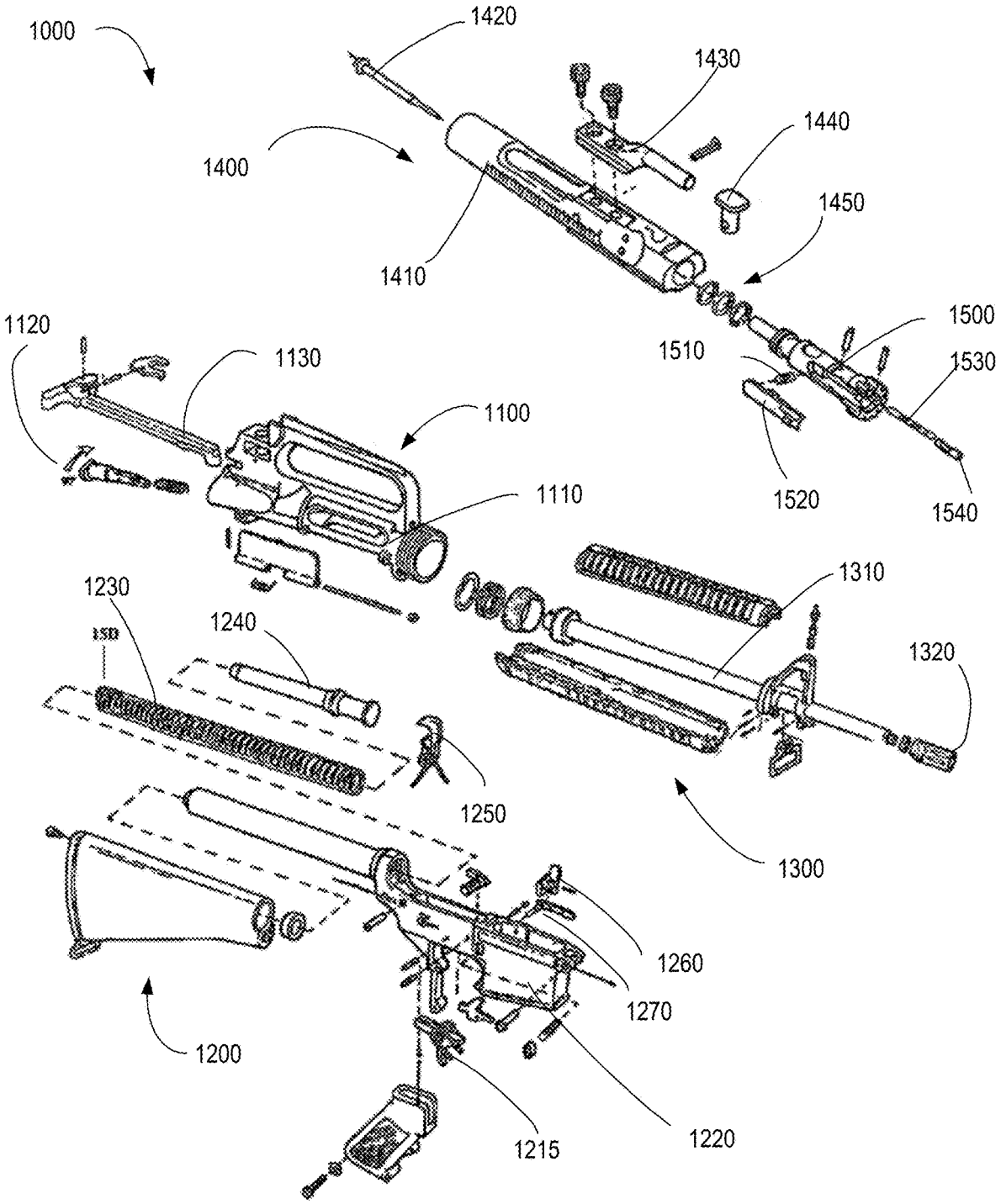
FIG. 3 (Prior Art)
FIG. 3 is a side perspective view of a disassembled AR-15 in the related art.
Figure 4:
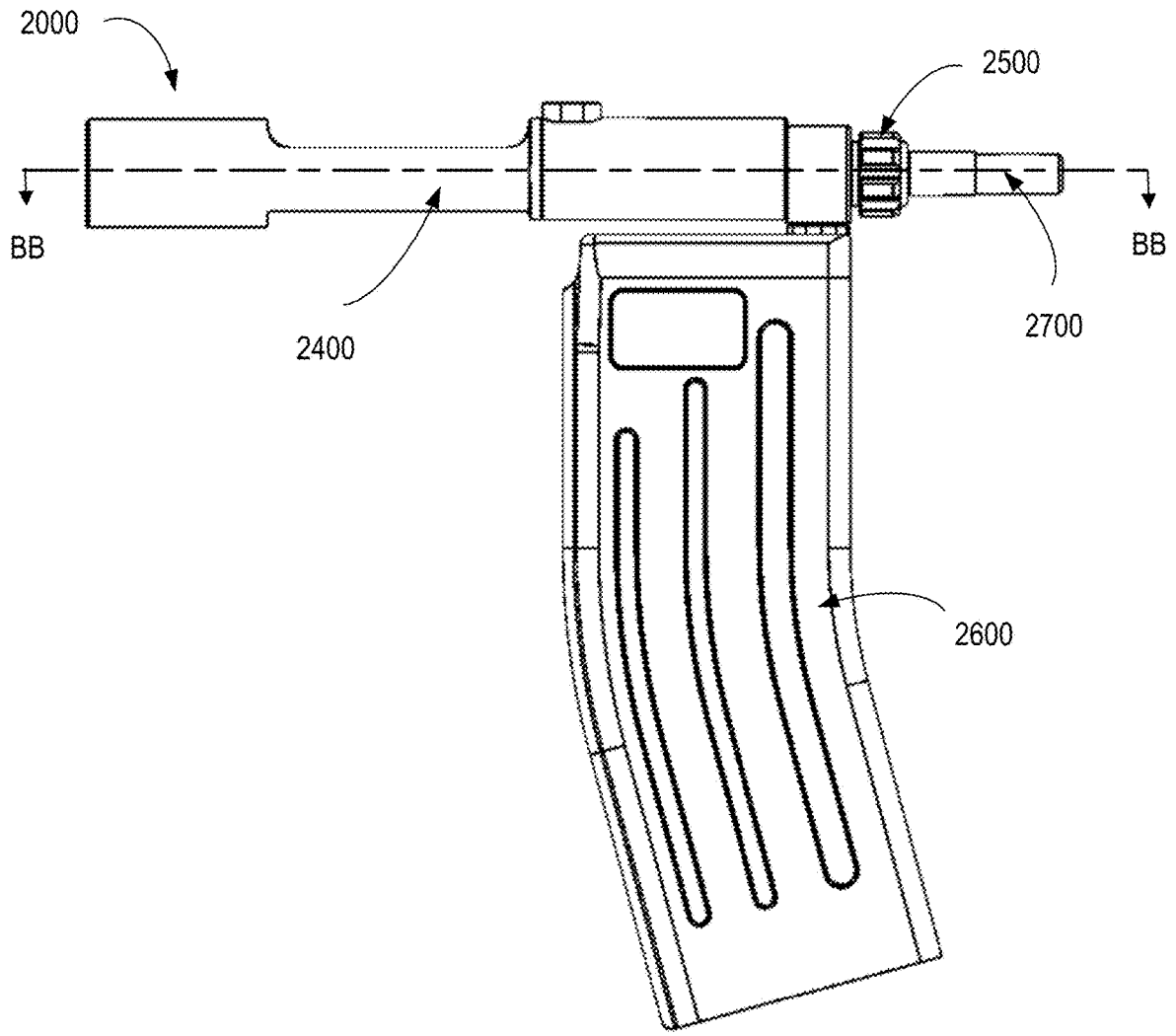
FIG. 4 is a side view of a training weapon system according to an embodiment.
Figure 5:
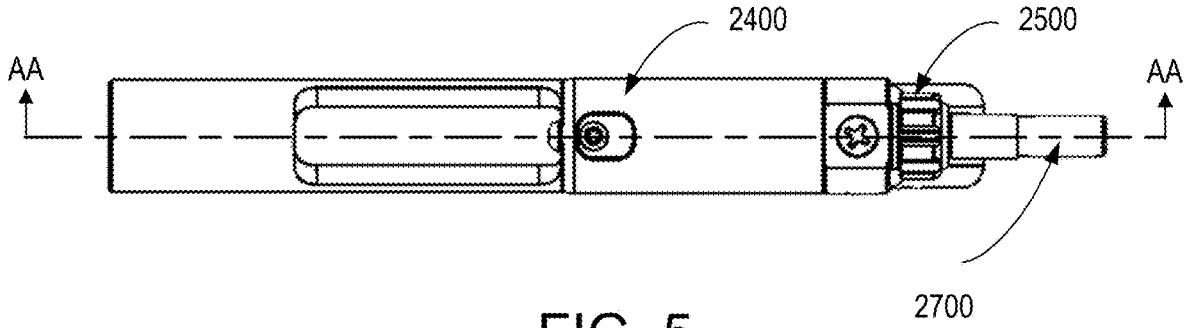
FIG. 5 is a top view of the training weapon system of FIG. 4.
Figure 6:
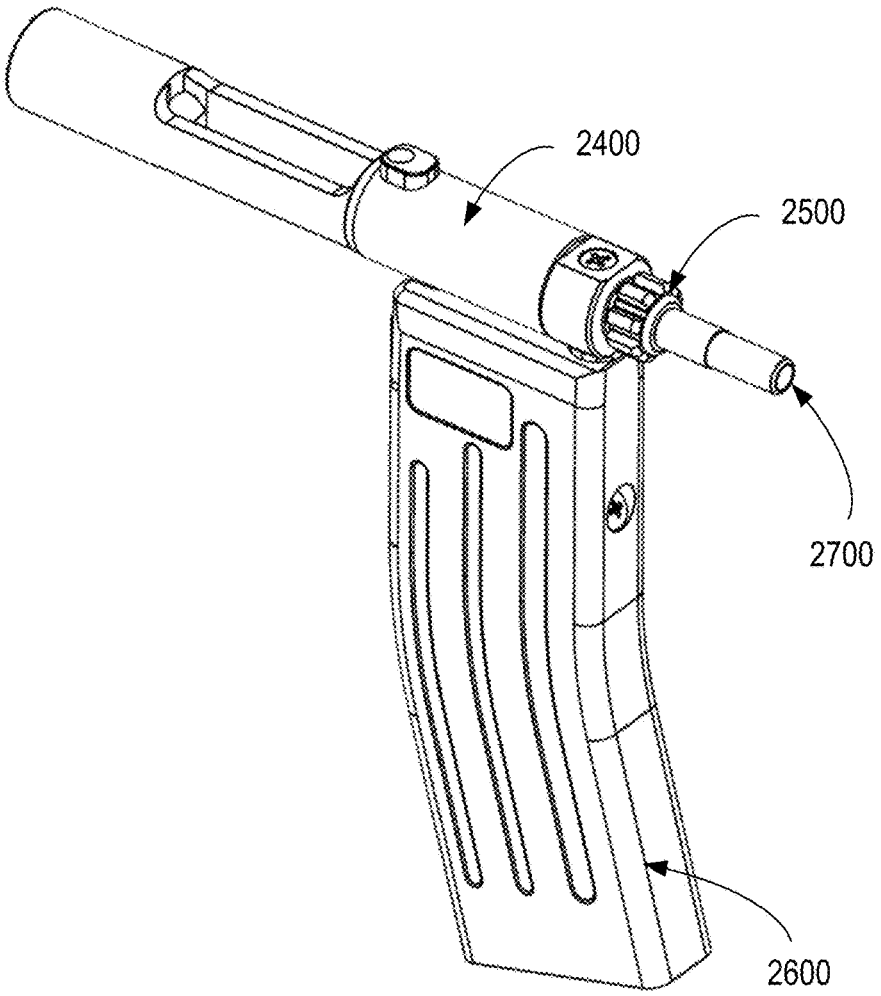
FIG. 6 is a side perspective view of the training weapon system of FIG. 4.
Figure 7:
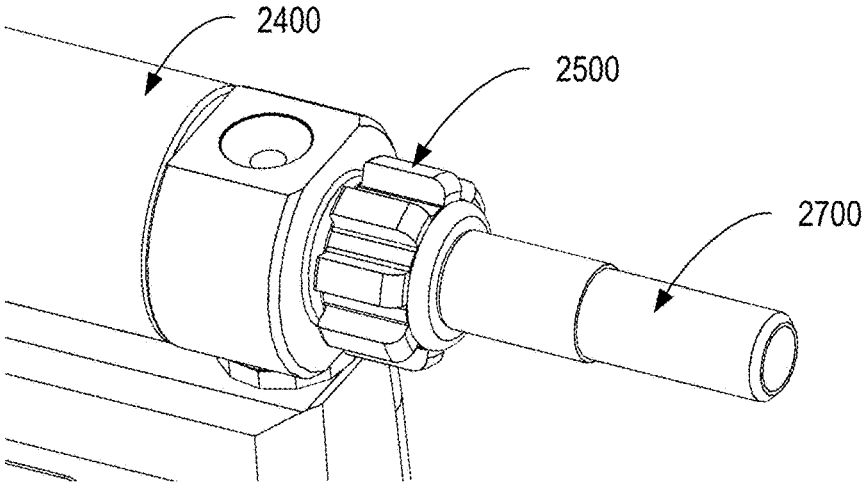
FIG. 7 is an enlarged side perspective view of the training weapon system of FIG. 4.

FIGS. 1-3 show a conventional AR-15 rifle 1000. The rifle 1000 includes an upper receiver assembly 1100, a lower receiver assembly 1200, a barrel assembly 1300, a bolt carrier group 1400, a bolt assembly 1500, and a magazine 1600. The upper receiver assembly 1100 includes an upper receiver 1110, a forward assist 1120, and a charging handle 1130. The lower receiver assembly 1200 includes a buttstock 1205, a hand grip 1210, a trigger 1215, a lower receiver 1220, an action spring 1230, a buffer assembly 1240, a hammer 1250, a bolt catch 1260, and a magazine catch 1270. The barrel assembly 1300 includes a barrel 1310 and a muzzle 1320. The bolt carrier group 1400 includes a bolt carrier 1410, a firing pin 1420, a bolt carrier key 1430, a cam pin 1440, and bolt gas rings 1450. The bolt assembly 1500 includes an extractor spring 1510, an extractor 1520, an ejector spring 1530, and an ejector 1540.

Once a magazine 1600 has been inserted into the rifle 1000, the charging handle 1130 can be pulled rearward and released by an operator. As the charging handle 1130 is pulled rearward, the charging handle 1130 engages a portion of the bolt carrier group 1400 and pulls the bolt carrier group 1400 along with the bolt assembly 1500 rearward in unison. As the bolt carrier group 1400 is moved rearward, the hammer 1250 is cocked during the rearward travel of the bolt carrier group 1400. When the operator releases the charging handle 1130, the bolt carrier group 1400 is advanced forward by the action spring 1230. As the bolt carrier group 1400 advances forward, the bolt assembly 1500 strips the next cartridge from the magazine 1600. As the bolt carrier group 1400 advances the bolt assembly 1500 and cartridge into the barrel 1310, the bolt assembly 1500 rotates relative to the bolt carrier group 1400 and partially into the bolt carrier group 1400 to lock the bolt assembly 1500 into place. When the operator pulls the trigger 1215, the hammer 1250 is actuated and strikes a proximal end of the cartridge, releasing the shot from the cartridge out through the barrel 1310. Since the bolt assembly 1500 is in the locked position, the pressurized gas (also referred to as blow back) from the cartridge does not immediately cause the bolt carrier group 1400 and bolt assembly 1500 to move rearward. Instead, gas from the gunpowder ignition returns from the barrel 1310 via a passage (not shown) and applies pressure on the bolt carrier key 1430 to force the bolt carrier group 1400 and bolt assembly 1500 back into an armed position. Depending on the cartridges selected, the muzzle energy may be in excess of about 3000 Joules (or about 2200 ft-lb). Thus, because replica weapons (e.g., airsoft weapons) do not use gunpowder ignition, the recoil feedback of such airsoft weapons is not comparable to an actual corresponding firearm. Moreover, modifying the airsoft weapons to operate at higher pressures to replicate more replicate more realistic conditions can be cost prohibitive and adversely alters the range and penetrative powers of the projectiles used with airsoft weapons, making them more dangerous and unsuitable for training purposes.

FIGS. 4-28 show a training weapon system 2000 adapted to retrofit the bolt carrier group 1400, bolt assembly 1500, and magazine 1600 of a rifle 1000 for a more realistic training experience. In particular, an operator can train with their own actual weapon using the training weapon system 2000 without projectiles while still experiencing the tactile and recoil feedback of conventional ammunition. The training weapon system 2000 can be configured to operate with any firearm, such as the AR-15 discussed above with reference to FIGS. 1-3. While the training weapon system 2000 will be discussed herein with reference to the AR-15 below, the size, shape, and/or tolerances of the training weapon system 2000 (or any other training weapon systems described herein) can be modified and adapted for use with other rifles and firearms, as will be appreciated to one skilled in the art in view of the present disclosure. Additionally, the training weapon system 2000 provides a "drop in" system that allows an actual weapon to be quickly converted to a training system and back to a regular weapon without any permanent or irreversible changes made to the weapon itself.

As shown in FIGS. 4-7, the training weapon system 2000 includes a trainer bolt carrier assembly 2400 (also referred to as bolt carrier assembly 2400), a trainer bolt assembly 2500 (also referred to as bolt assembly 2500), a trainer magazine assembly 2600 (also referred to as magazine assembly 2600), and a target hit detection system 2700. One or more of the bolt carrier assembly 2400, bolt assembly 2500, the magazine assembly 2600, and target hit detection system 2700 can be bundled together as part of a drop in conversion kit to convert an actual firearm into a training system.

Figure 14:
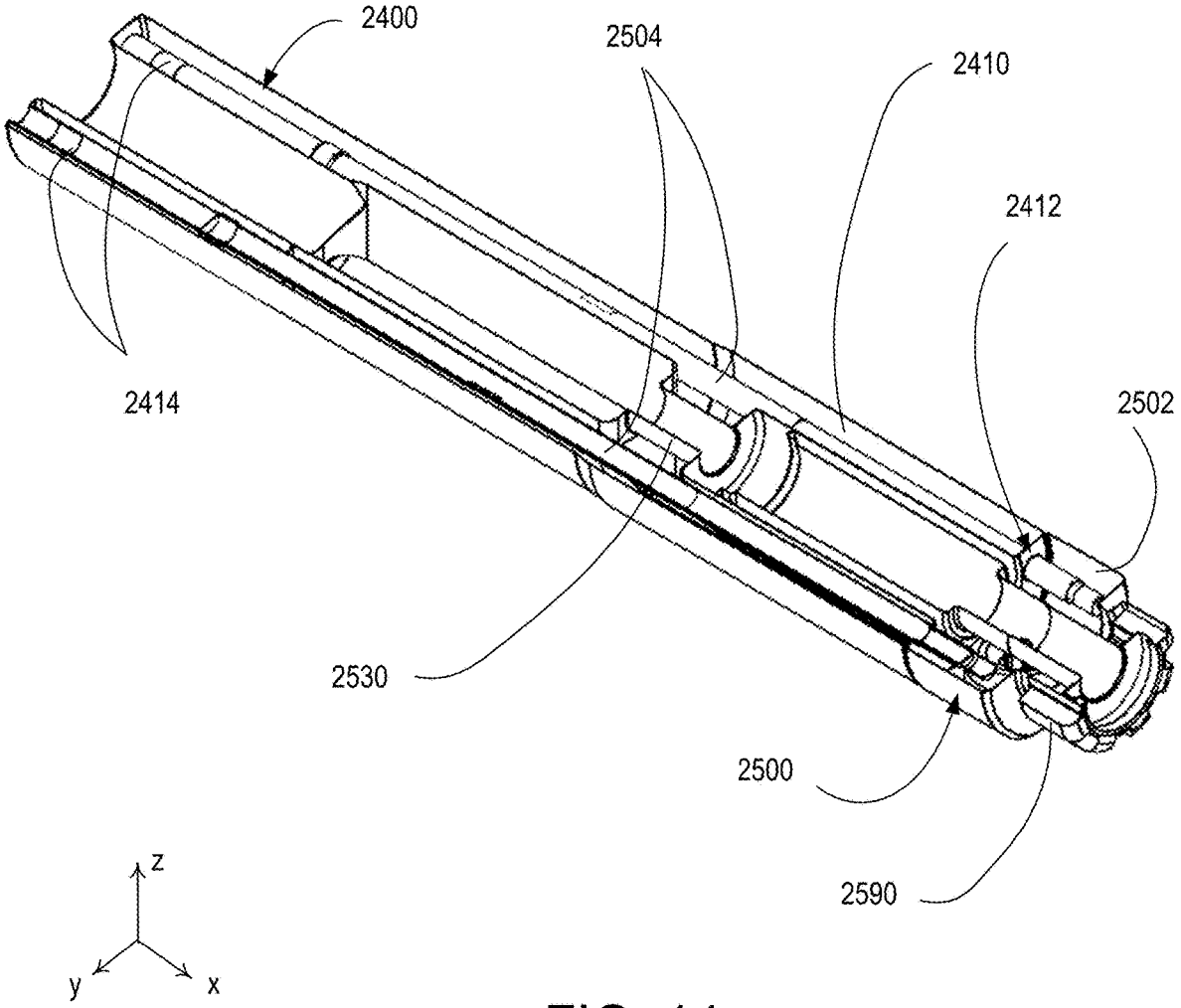
FIG. 14 is an enlarged partial cross-sectional view of FIG. 4 taken at line BB-BB.

As shown in FIG. 14, the bolt assembly 2500 includes a bolt body member 2502 having a proximal end portion and a distal end portion. The bolt body member defines a longitudinal axis extending from the proximal end to the distal end. The bolt assembly 2500 includes a guide member 2504 attached to the proximal end portion such that the guide member is parallel to the longitudinal axis. The bolt assembly 2500 includes a bolt chamber interface 2590 attached to a distal end portion of the bolt body member 2502 and that is configured to nest within an interior wall of a firearm chamber. The bolt chamber interface 2590 is configured to limit rotational and axial movement of the bolt assembly relative to the firearm chamber. In some embodiments, the bolt carrier assembly 2400, the bolt assembly 2500, and the target hit detection system 2700 are pre-assembled prior to installing the training system in the rifle 1000. For example, the bolt assembly 2500 and the target hit detection system 2700 can be inserted into and press-fit by hand into the barrel 1310 while the upper and lower receiver assemblies 1100, 1200 are disassembled and separated. In some embodiments, the bolt assembly 2500 can be rotated relative to the barrel assembly 1300 to lock the bolt assembly 2500 in place. After the upper and lower receiver assemblies 1100, 1200 of the rifle 1000 have been reassembled, the magazine assembly 2600 can be attached to the bolt assembly 2500 as discussed in further detail below. The installation of the training weapon system 2000 can be performed by hand and quickly enables a conventional weapon to be converted into a training system and back again to a weapon by reversing the procedure described herein.

Figure 15:
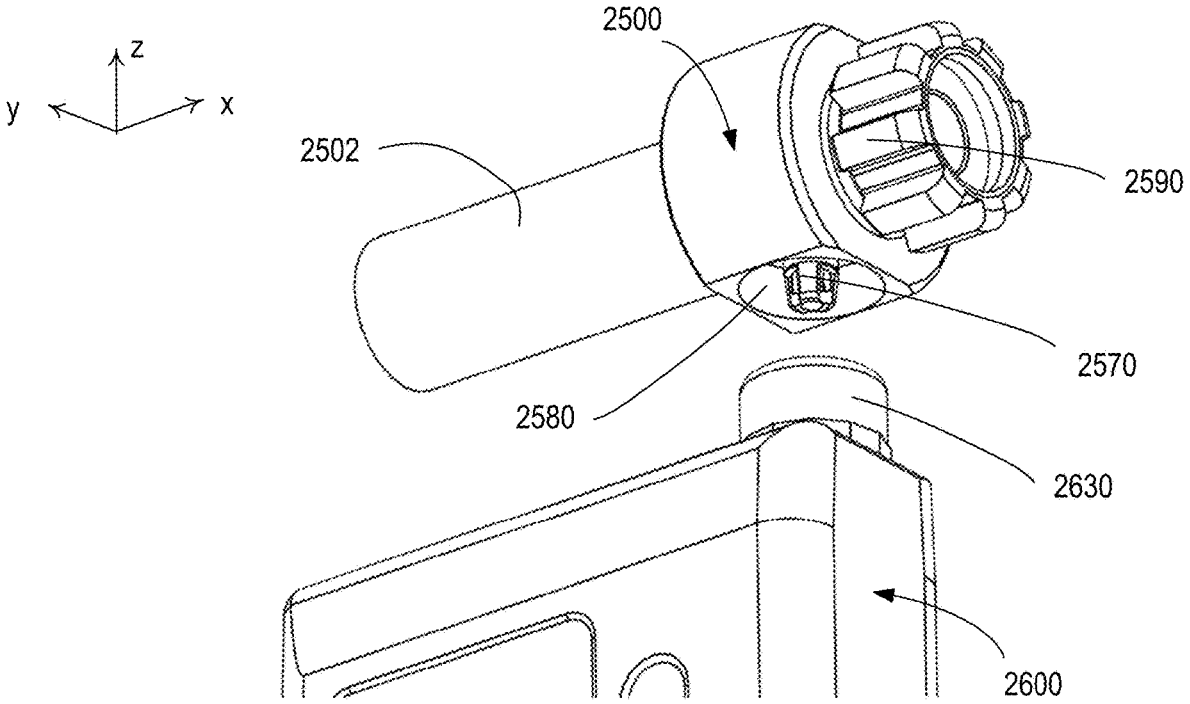
FIG. 15 is a bottom perspective view of the bolt assembly and the magazine assembly shown in FIG. 6 in a de-coupled state.

As shown in FIG. 15, the bolt assembly 2500 includes a bolt nipple connector 2570 for mating with a nipple assembly 2630 of a magazine assembly 2600. The bolt carrier assembly 2400 includes a bolt carrier body 2410 and a guide member receiver 2412 extending through at least a portion of the bolt carrier body 2410. The bolt carrier body 2410 is configured to slide relative to the bolt assembly 2500, the bolt carrier body 2410 being slidable along the guide member 2504 via the guide member receiver 2412 in a direction parallel to the longitudinal axis.

Figure 16:
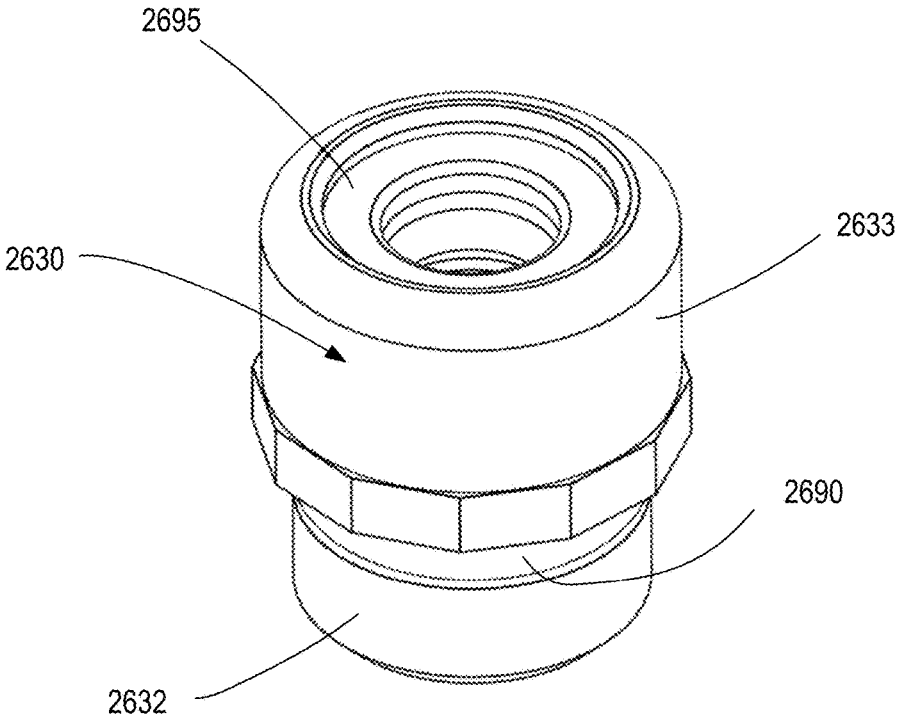
FIG. 16 is a perspective view of the nipple assembly of the magazine assembly shown in FIG. 15.
Figure 20:
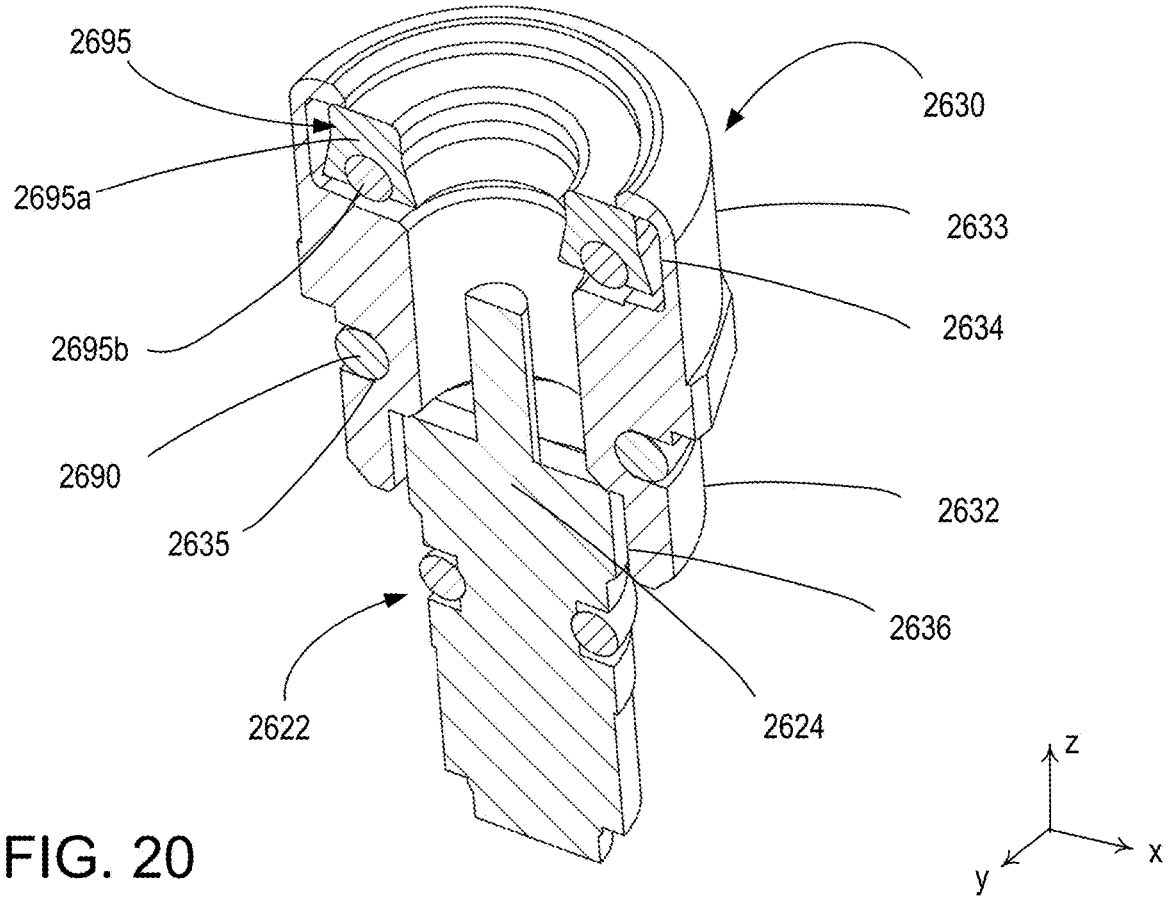
FIG. 20 is an enlarged cross-sectional view of the nipple assembly taken at the line AA-AA in FIG. 4.

As shown in FIGS. 15 and 16, the magazine assembly 2600 includes a nipple assembly 2630. The nipple assembly 2630 includes a proximal portion 2632 and a distal portion 2633. The distal portion 2633 includes a recess 2634 configured to retain a sealing member 2695 that extends radially inward relative to the nipple assembly 2630. As shown in FIG. 20, in some embodiments, the sealing member 2695 includes a first seal element 2695*a* and a second seal element 2695*b*, the first seal element 2695*a* at least partially surrounding the second seal element 2695*b*. In some embodiments, the first seal element 2695*a* is a U-shaped or a C-shaped member. In some embodiments, the proximal portion 2632 includes a recess 2635 configured to retain a second sealing member 2690 that extends radially outward relative to the nipple assembly. The proximal portion 2632 includes an inner circumferential surface 2636 for receiving the valve core 2622. In some embodiments, the inner circumferential surface 2636 is defined by a radius of about 0.762 cm (0.30 inches) to about 0.813 cm (0.32 inches). In some embodiments, a length of the inner circumferential surface 2636 is between about 0.254 cm (0.1 inches) to about 0.635 cm (0.25 inches).

Figure 21:
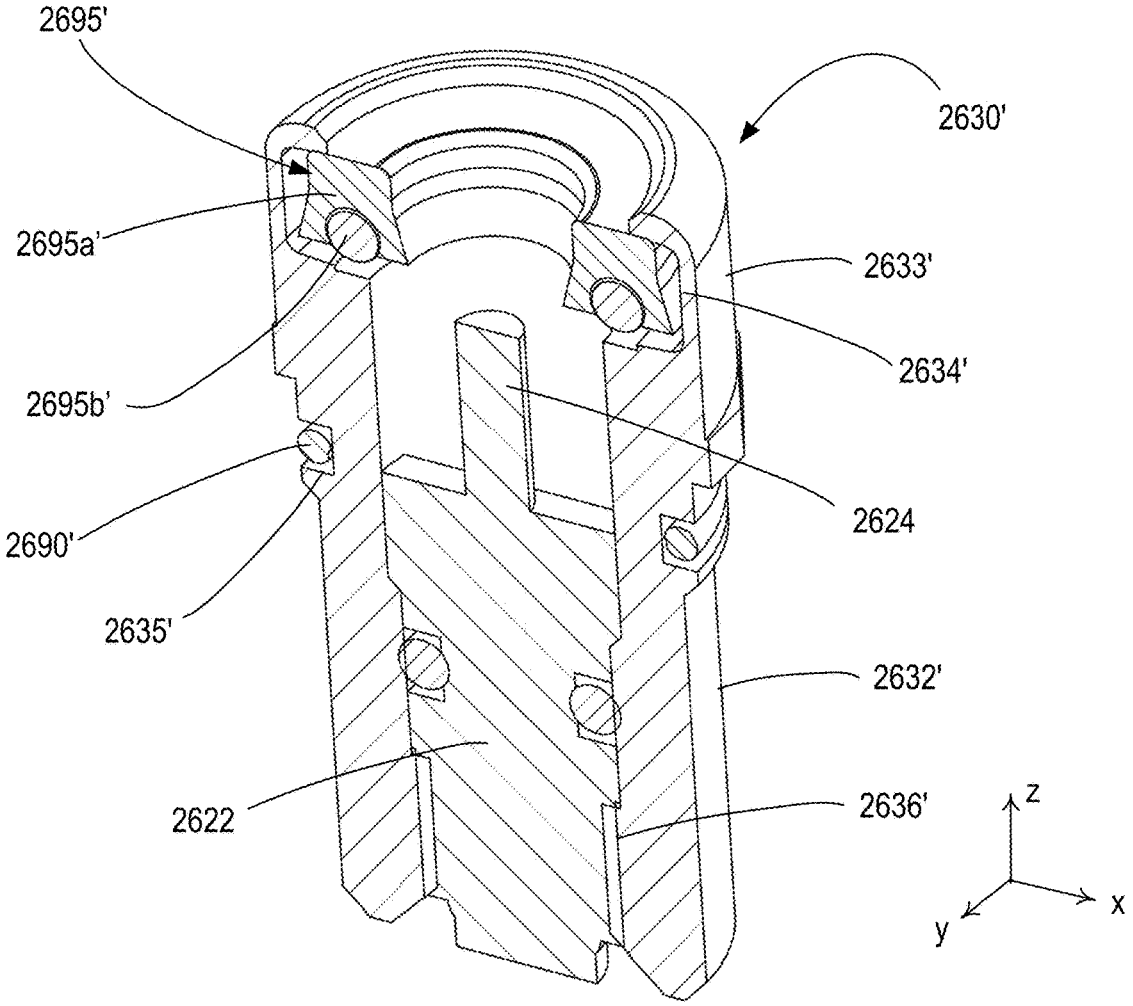
FIG. 21 is an enlarged cross-sectional view of a nipple assembly according to an embodiment.

In some embodiments, as shown in FIG. 21, the magazine assembly 2600 includes a nipple assembly 2630' with a distal portion 2633' and an extended proximal portion 2632'. The distal portion 2633' includes a recess 2634' configured to retain a sealing member 2695' that extends radially inward relative to the nipple assembly 2630'. The sealing member 2695' includes a first seal element 2695*a*' and a second seal element 2695*b*', the first seal element 2695*a*' at least partially surrounding the second seal element 2695*b*'. In some embodiments, the first seal element 2695*a*' is a U-shaped or a C-shaped member. In some embodiments, the proximal portion 2632' includes a recess 2635' configured to retain a second sealing member 2690' that extends radially outward relative to the nipple assembly. The extended proximal portion 2632' includes an inner circumferential surface 2636' for receiving the valve core 2622. The extended proximal portion 2632' includes an inner circumferential surface 2636' for receiving the valve core 2622. In some embodiments, the inner circumferential surface 2636' is defined by a radius of about 0.508 cm (0.20 inches) to about 0.762 cm (0.30 inches). In some embodiments, a length of the inner circumferential surface 2636' is between about 0.508 cm (0.2 inches) to about 1.27 cm (0.50 inches). The increased length improves contact and sealing between the extended proximal portion 2632' and the valve core 2622. In some embodiments, the inner circumferential surface 2636' is also a continuous surface along its length and is devoid of a shoulder (as shown in the nipple assembly 2630; see FIG. 20) that can contact the valve core 2622 and prevent axial motion thereof.

Figure 23:
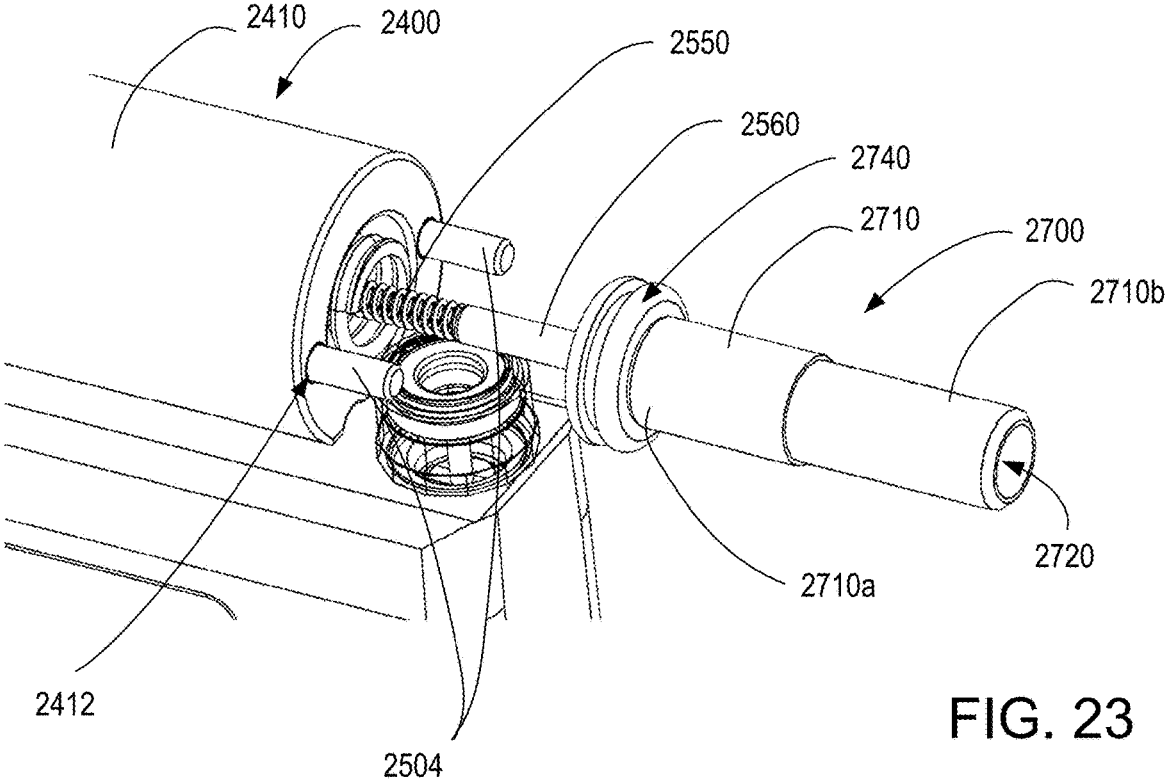
FIG. 23 is a front side perspective view of the training weapon system shown in FIG. 4 with the bolt body removed to show internal details.
Figure 24:
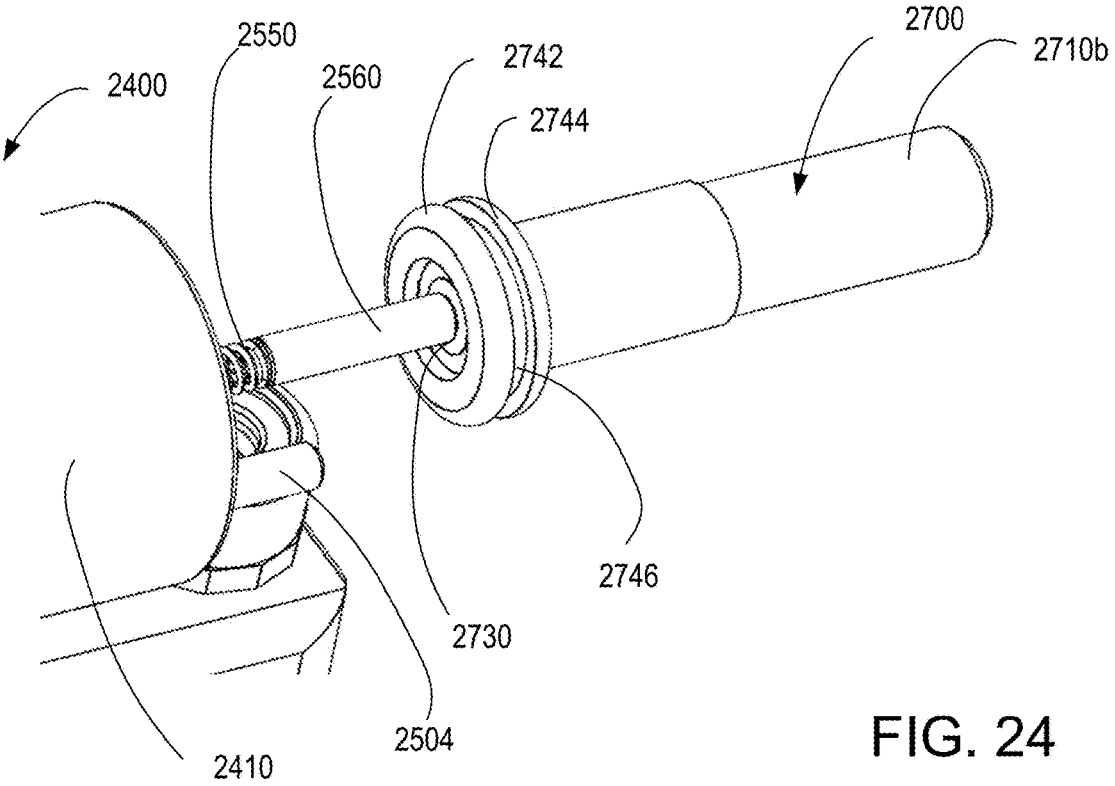
FIG. 24 is a back side perspective view of the training weapon system shown in FIG. 4 with bolt body removed to show internal detail.

The target hit detection system 2700 is operable to produce and emit a wireless signal. A compatible receiver (not shown) is configured to monitor for the wireless signal to detect whether the wireless signal emitted by the target hit detection system 2700 has made a "hit" at or near the location of the receiver. In some embodiments, the target hit detection system 2700 is a laser targeting system. As shown in FIGS. 23 and 24, the laser targeting system 2700 includes a laser body 2710 having a proximal end portion 2710*a* and a distal end portion 2710*b*. The laser targeting system 2700 includes a laser output 2720 at the distal end portion 2710*b*. The laser targeting system includes a switch 2730 at the proximal end portion 2710*a*. In some embodiments, the wireless signal is a signal transmitted at an ultraviolet wavelength, a visible wavelength, and/or an invisible wavelength. In some embodiments, the wireless signal is an analog signal or a digital signal.

Figure 8:
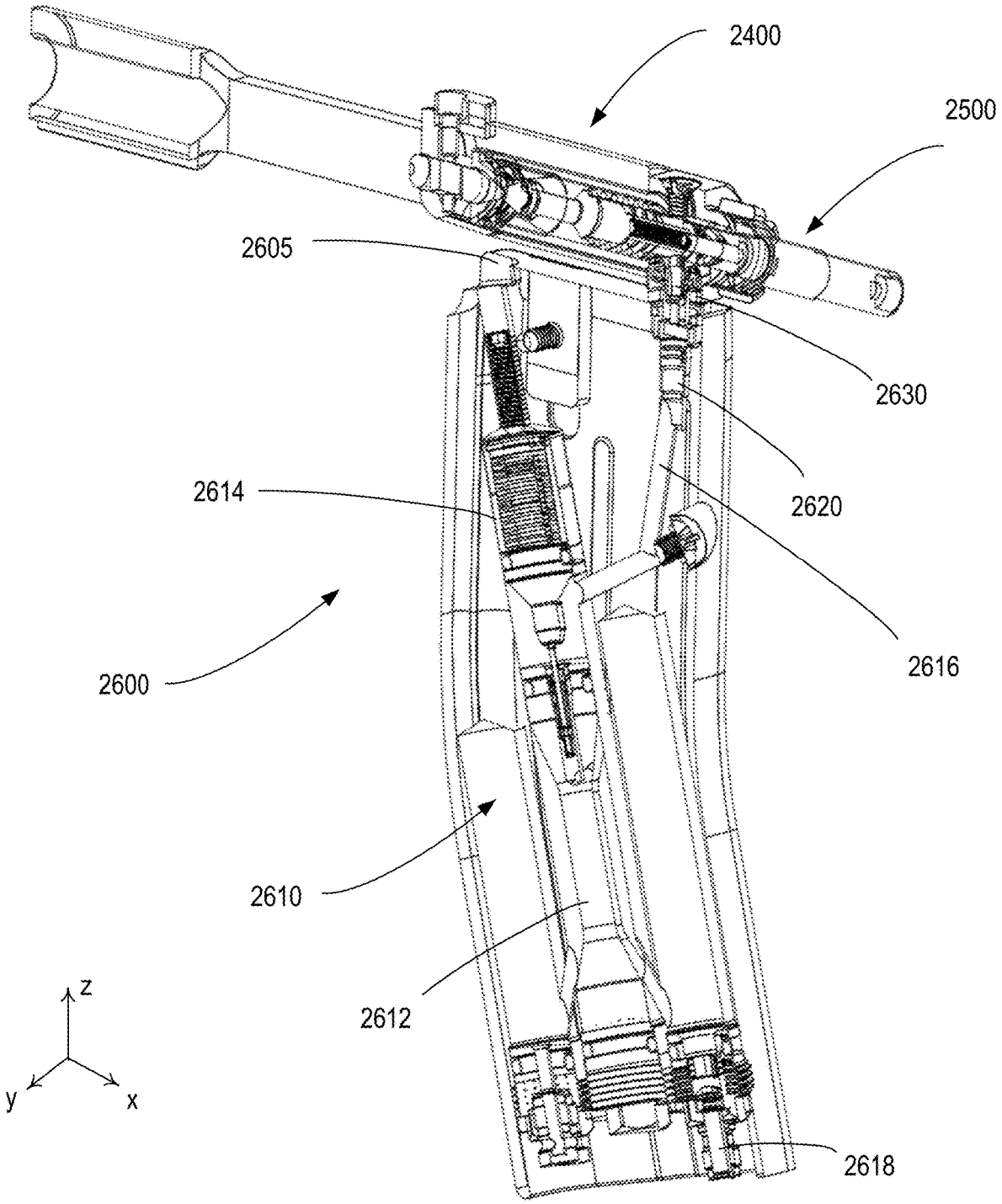
FIG. 8 is a perspective cross-sectional view of FIG. 5 taken at line AA-AA.
Figure 9:
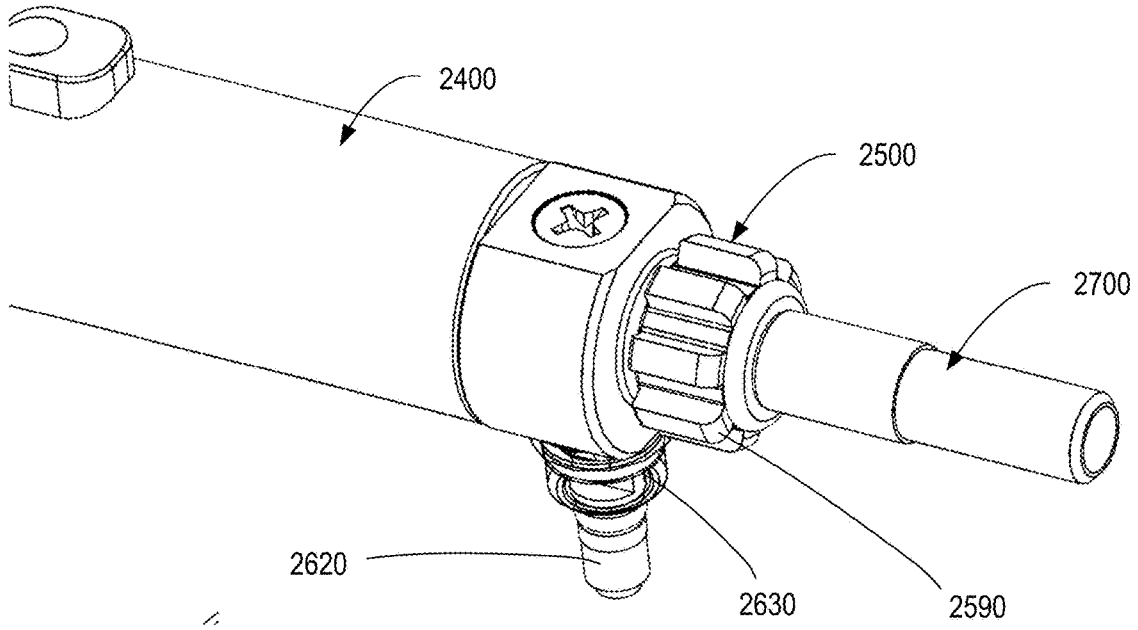
FIG. 9 is an enlarged side perspective view of the bolt assembly and laser assembly of the training weapon system of FIG. 4.
Figure 17:
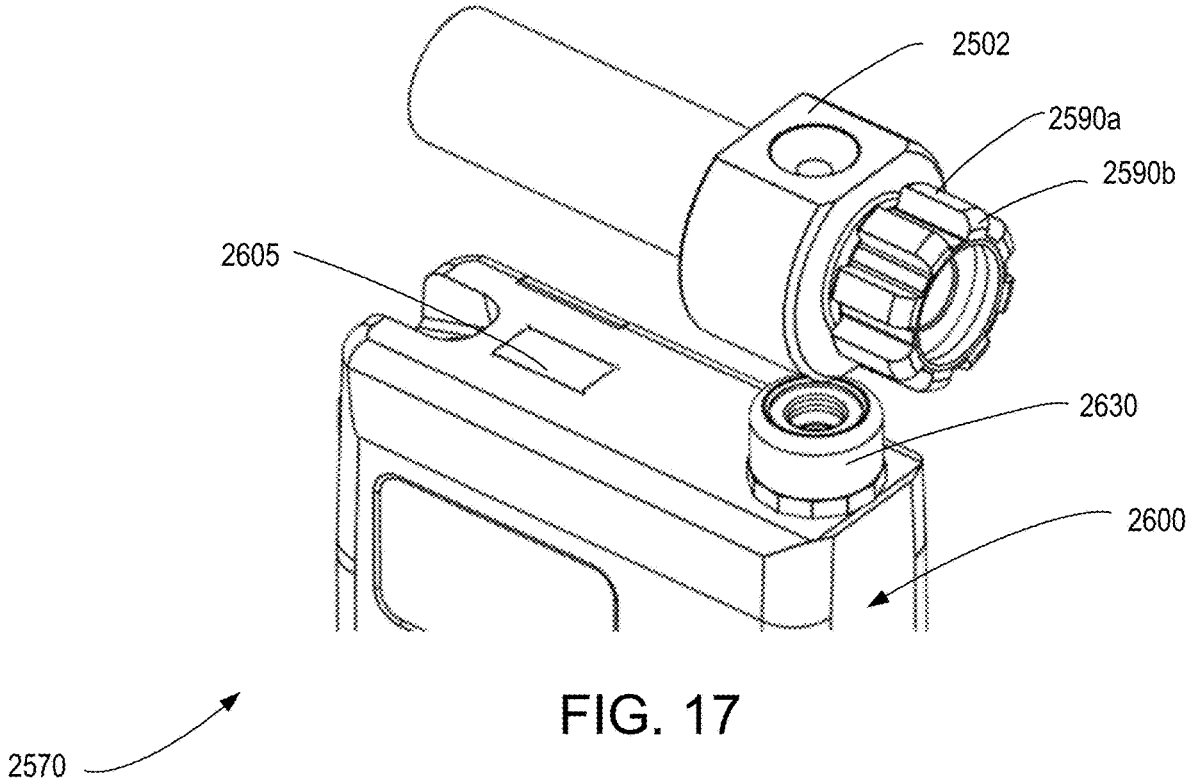
FIG. 17 is a top perspective view of the bolt assembly and the magazine assembly shown in FIG. 15 in the de-coupled state.
Figure 25:
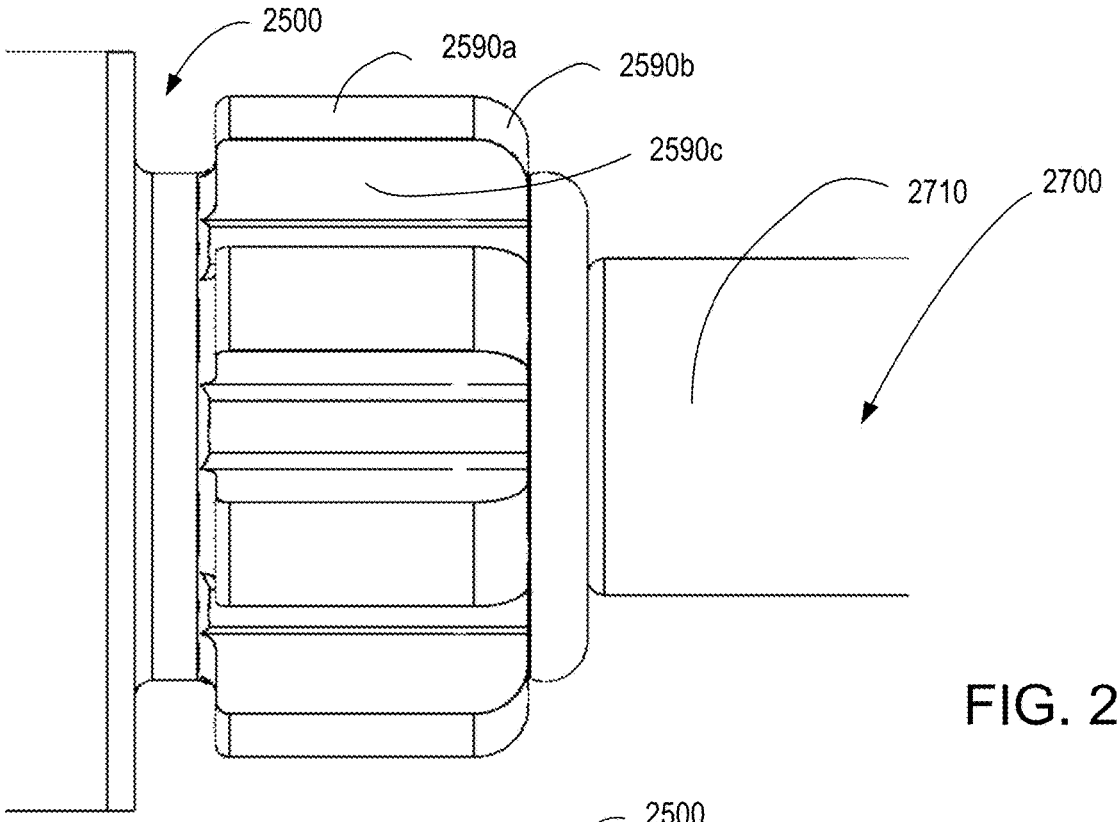
FIG. 25 is a side view of the mounting member between the bolt assembly and the laser assembly of the training weapon system shown in FIG. 4.

With reference to FIGS. 8-14, general operation of the training weapon system 2000 will now be described. The training weapon system 2000 is configured to be installed into the chamber of a firearm, such as between the upper receiver assembly 1100 and the lower receiver assembly 1200 of the AR-15 rifle 1000 in FIGS. 1-3. The bolt assembly 2500 includes a bolt chamber interface 2590 configured to nest within an interior of the barrel 1310. The bolt chamber interface 2590 includes a plurality of radially extending protrusions. As shown in FIGS. 9, 17, and 25, each of the protrusions (or lugs) of the bolt chamber interface 2590 includes a first contact surface 2590*a* and a second contact surface 2590*b* for engaging the barrel 1310 of the barrel assembly 1300. Each protrusion of the bolt chamber interface 2590 includes sidewalls 2590*c* extending outwardly from a center of the bolt chamber interface 2590. Although the bolt chamber interface 2590 is depicted in FIG. 17 as including a total of twelve protrusion, in some embodiments, the bolt chamber interface 2590 can include three to eleven protrusions.

The bolt chamber interface 2590 is sized to engage corresponding lugs within the barrel 1310 to prevent movement of the bolt assembly 2500 relative to the barrel 1310 during operation of the training weapon system 2000. In some embodiments, the first contact surface 2590*a* extend parallel to a longitudinal axis of the bolt assembly 2500. In some embodiments, the second contact surface 2590*b* extends in both an axial and radial direction to engage and lock to the barrel 1310. For example, the second contact surface 2590*b* can include a rounded or chamfered surface. The bolt chamber interface 2590 includes a plurality of bolt lugs dimensioned to interlock with corresponding lugs of the barrel 1310 and prevent rotation of the bolt assembly 2500 during operation. The bolt chamber interface 2590 further aligns and centers the target hit detection system 2700 within the barrel. The bolt chamber interface 2590 accounts for misalignment and any eccentricity associated with each individual firearm due to variations from manufacturing tolerances and/or wear due to use. For example, in some embodiments, to provide a tight fit and to account for variations that are present, even across the same make and model of a firearm, the bolt chamber interface 2590 is dimensioned to fit within the MIL-SPEC of the barrel 1310 and have a tolerance of between about ±0.00254 cm (±0.001 inches) and about ±0.00508 cm (±0.002 inches). By comparison, the proximal end of the bolt carrier assembly 2400 is dimensioned to fit within the MIL-SPEC of the chamber and have a tolerance of up to about 0.02032 cm (0.008 inches). The bolt chamber interface 2590 engages the barrel 1310 to prevent lateral movement of the bolt assembly 2500 relative to a longitudinal axis of the barrel 1310 and improve centering and stability of the target hit detection system 2700, as will be described in greater detail below. In some embodiments, the lugs of the bolt chamber interface 2590 are about 5 to 25% longer in length (in a direction parallel to the longitudinal axis of the barrel 1310) than bolt lugs of a conventional bolt assembly in a corresponding firearm. For example, in some embedment's, the length of the lugs are between about 0.762 cm (0.3 inches) to about 0.9525 cm (0.375 inches). The lugs of the bolt chamber interface 2590 prevent rotation between the bolt assembly 2500 and the barrel 1310 during operation. In some embodiments, the lugs of the bolt chamber interface 2590 are about 10% longer than bolt lugs of a conventional bolt assembly in a corresponding firearm. For example, the length of the bolt lugs in a conventional AR-15 rifle 1000 are about 0.699 cm (0.275 inches) and the length of the lugs of the bolt chamber interface 2590 are about 0.787 cm (0.310 inches) in length. In some embodiments, the length of the lugs of the bolt chamber interface 2590 are up to about 1.105 cm (0.435 inches).

Once the training weapon system 2000 has been installed into the rifle 1000, the system 2000 can be operated to simulate a fired shot. As shown in FIGS. 8-12, the magazine assembly 2600 includes an energy storage system 2610. In some embodiments, the energy storage system 2610 can be configured to store and dispense a fuel, propellent, a pressurized gas, or electrical energy for use with one or more of a combustion chamber, a mechanical actuator, an electrical actuator, and/or electro-mechanical actuator.

As shown in FIG. 8, the energy storage system 2610 includes an energy storage device 2612, a pressure regulator 2614, a supply line 2616, an access port 2618, and a supply valve 2620. The supply valve 2620 includes a valve core 2622 and a valve actuator pin 2624. In some embodiments, the energy storage device 2612 is a pressurized gas canister and is configured to store a pressurized gas up to about 27579 kPa (4000 psi). The pressure regulator 2614 is configured to regulate pressure supplied to the supply line 2616 to about 3447.4 kPa (500 psi). When the magazine assembly 2600 is coupled to the bolt assembly 2500, the pressurized gas is free to flow from the supply line 2616 through the supply valve 2620 and into the bolt assembly 2500. Once the magazine assembly 2600 is coupled to the bolt assembly 2500, an interior of the bolt assembly 2500 remains pressurized until the magazine assembly 2600 is depleted or is removed from the bolt assembly 2500. By keeping the bolt assembly 2500 pressurized, the training weapon system 2000 can simulate an armed weapon that is ready for operation without a further startup or pressurization step in between simulated rounds or in between intermittent use. In some embodiments, the pressurized gas is compressed ambient or atmospheric air. In some embodiments, the pressurized gas can be any inert gas, such as nitrogen.

Figure 12:
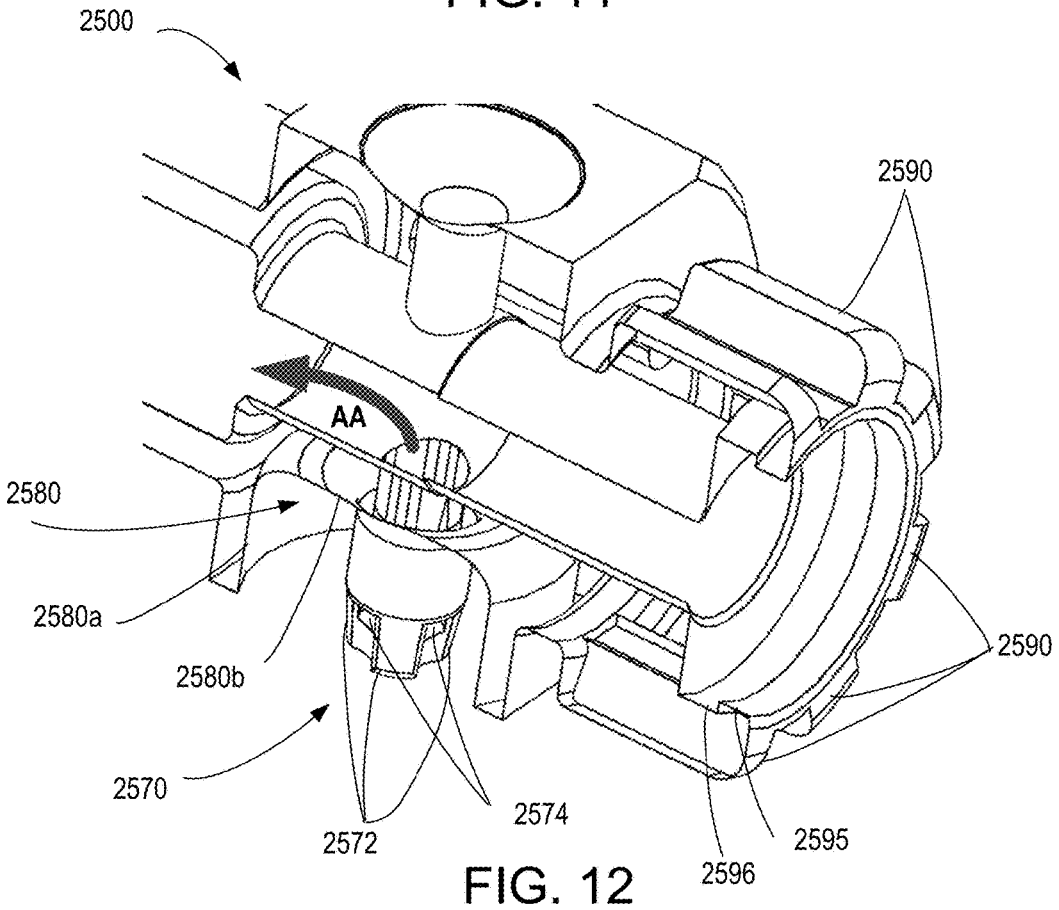
FIG. 12 is an enlarged partial cross-sectional view of FIG. 10.
Figure 13A:
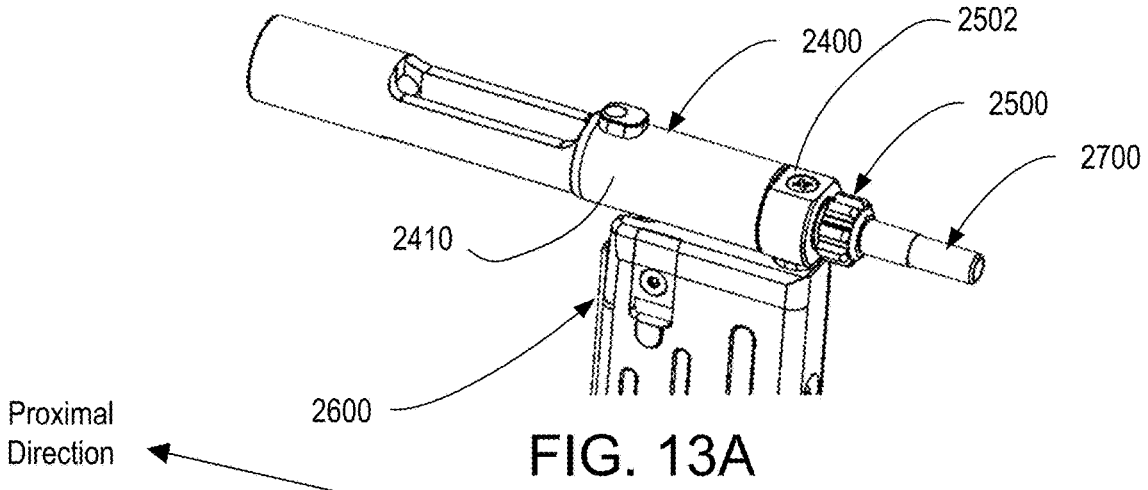
FIG. 13A is a side perspective view of the training weapon system of FIG. 4 in a first operating position according to an embodiment.
Figure 13B:
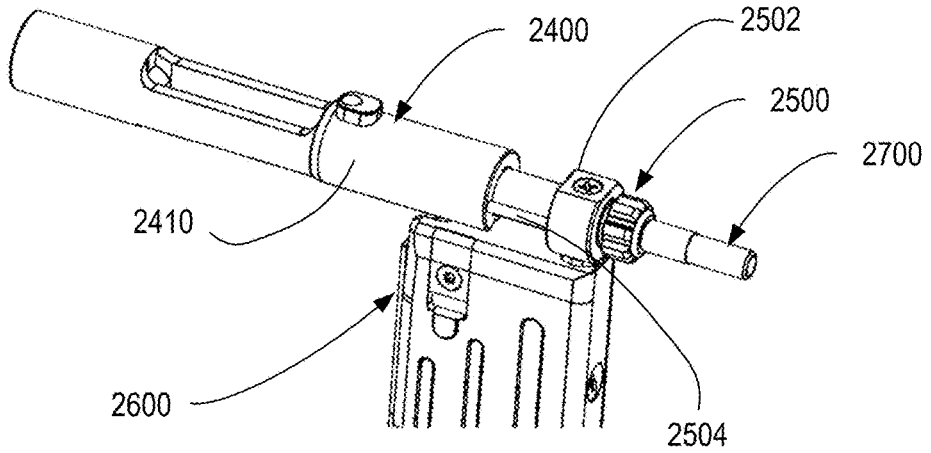
FIG. 13B is a side perspective view of the training weapon system of FIG. 4 in a second operating position according to an embodiment.
Figure 13C:
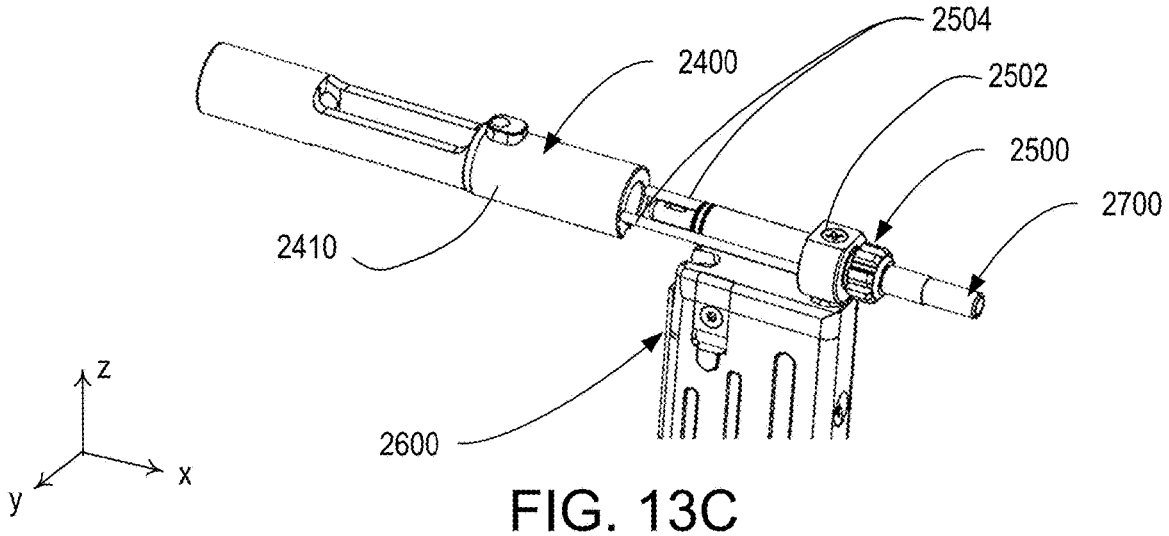
FIG. 13C is a side perspective view of the training weapon system of FIG. 4 in a third operating position according to an embodiment.

As the pressurized gas flows from supply valve 2620 to the bolt assembly 2500, as indicated by the arrow AA in FIG. 12, the pressurized gas flows through connector ports 2576 (see FIG. 19) of the bolt nipple connector 2570. The pressurized gas enters an interior volume of the bolt body member 2502 and pressurizes the interior volume to about 3447.4 kPa (500 psi). In some embodiments, the pressure regulator 2614 is configured to regulate the pressure supplied to the interior volume to about 1723.7 kPa (250 psi) to 6894.8 kPa (1000 psi). In some embodiments, the pressure regulator 2614 is configured to regulate the pressure supplied to the interior volume to about 3102.6 kPa (450 psi) to 4136.9 kPa (600 psi).

Figure 10:
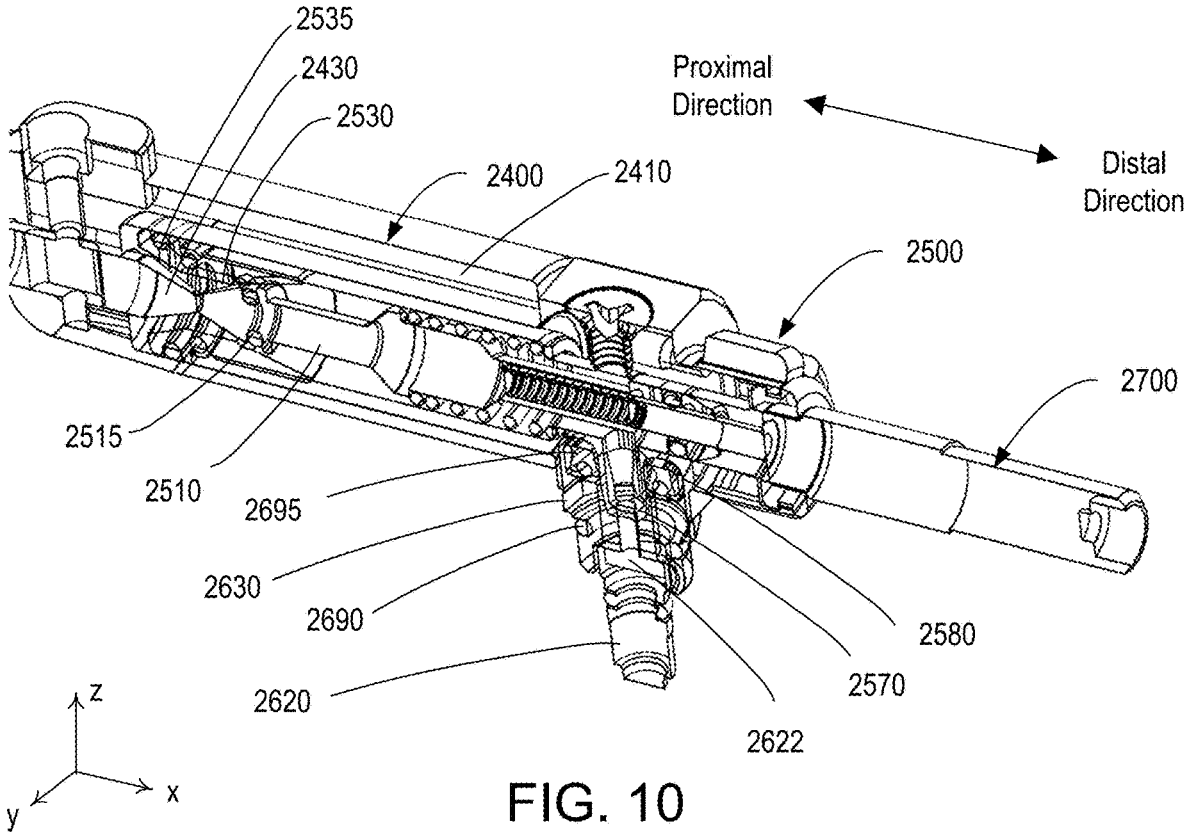
FIG. 10 is an enlarged perspective cross-sectional view of FIG. 4 taken at the line AA-AA.
Figure 11:
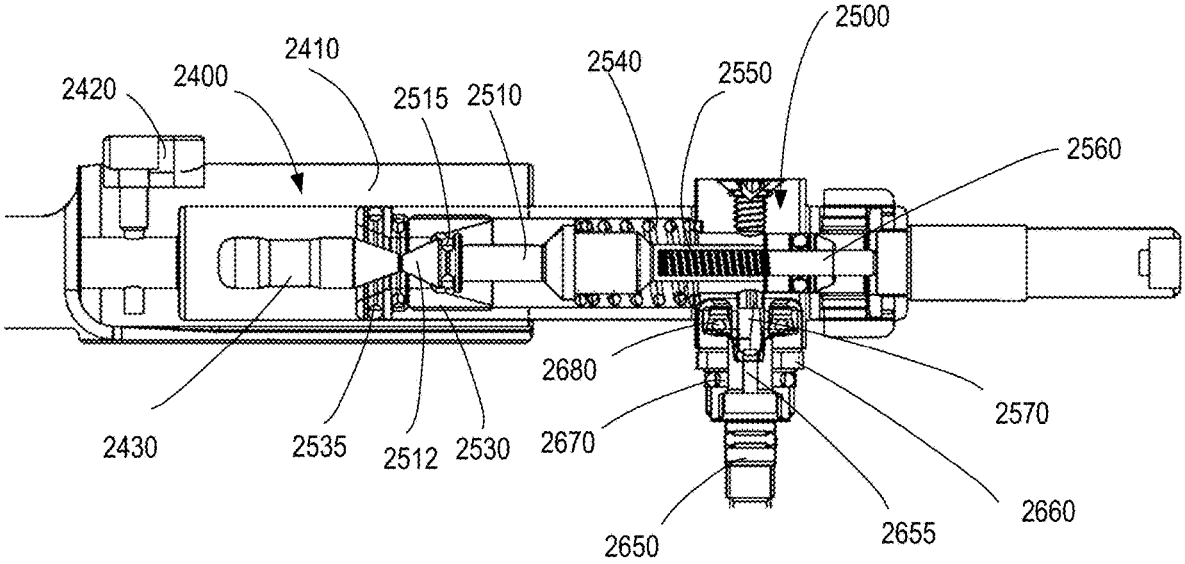
FIG. 11 is an enlarged side cross-sectional view of FIG. 4 taken at the line BB-BB.

As shown in FIGS. 10 and 11, the bolt assembly 2500 includes a balanced core 2510, a balanced core seal member 2515, a bolt cap 2530, a bolt cap seal member 2535, and a spring member 2540. The bolt cap 2530 includes a conically tapered interior surface, the conical taper having a first inner diameter at a distal end of the bolt cap 2530 and a second inner diameter at a proximal end of the bolt cap 2530. The first inner diameter is greater than the second inner diameter. In some embodiments, the first inner diameter is about 1.016 cm (0.4 inches) and the second inner diameter is about 0.635 cm (0.25 inches). The spring member 2540 together with the pressurized gas within the bolt body member 2502 biases the balanced core 2510 towards the proximal end of the bolt cap 2530. The balanced core 2510 includes a tapered head member 2512 that extends into the conically tapered interior surface of the bolt cap 2530 and at least partially through the balanced core seal member 2515 when the bolt carrier body 2410 is in the home position. The balanced core seal member 2515 is seated within and engages the second inner diameter of the bolt cap 2530. The balanced core seal member 2515 includes an outer diameter greater than the second inner diameter of the bolt cap 2530. In some embodiments, the balanced core seal member 2515 is an O-ring.

As shown in FIG. 10, the bolt carrier body 2410 is in a distal-most position (also referred to as a home position). During operation, an operator can pull the trigger 1215 of the rifle 1000 and the trigger 1215 in turn actuates the hammer 1250 and causes the firing pin 2430 to move in a distal direction. The firing pin 2430 in turn strikes a proximal end of the balanced core 2510 causing the balanced core 2510 to also move in the distal direction. As the balanced core 2510 moves in the distal direction, the balanced core seal member 2515 unseats from the second inner diameter of the bolt cap 2530, thereby allowing pressurized gas to exit from the bolt body member 2502 and travel into the bolt carrier body 2410. The pressurized gas rapidly travels past the firing pin 2430 and into an interior of the bolt carrier body 2410.

As shown in FIG. 11, the bolt cap seal member 2535 seals the pressurized gas at the distal end of the bolt carrier body 2410. During this sequence of events, illustrated in FIGS. 13A-13C, the pressurized gas entering into the interior of the bolt carrier body 2410 forces the bolt carrier body 2410 to move rapidly in the proximal direction away from the bolt body member 2502. Because of the high pressure supplied to an interior of the bolt carrier body 2410, the proximal movement of the bolt carrier body 2410 towards the buttstock 1205 simulates the recoil of a live round being fired from the rifle 1000. Once the bolt carrier body 2410 reaches a proximal-most position (also referred to as a recoil position), the pressurized gas is released from the bolt carrier body 2410. The action spring 1230 of the lower receiver assembly, which compresses during the proximal movement of the bolt carrier body 2410, expands after the release of the pressurized gas from the bolt carrier body 2410 and causes the bolt carrier body 2410 to return back to the home position.

As shown in FIGS. 13B, 13C, 14 and 22, the bolt assembly 2500 includes at least one guide rail 2504 to control the movement of the bolt carrier body 2410 relative to the bolt assembly 2500 during travel between the home and recoil positions. The at least one guide rail 2504 is secured to the bolt body member 2502 via a fastening mechanism. In some embodiments, the at least one guide rail 2504 includes a threaded end and the bolt carrier body 2410 includes a corresponding threaded receiver. In some embodiments, the at least one guide rail 2504 is formed monolithically with the bolt body member 2502. The at least one guide rail 2504 is configured to maintain alignment of the bolt carrier body 2410 with the bolt assembly 2500 throughout its range of travel from the home position to the recoil position and back to the home position. The at least one guide rail 2504 is parallel the longitudinal axis of the bolt assembly 2500. In some embodiments, the at least one guide rail 2504 includes two guide rails to resist flex and torsional forces during operation. In some embodiments, the at least one guide rail 2504 includes two to five guide rails.

Figure 18:
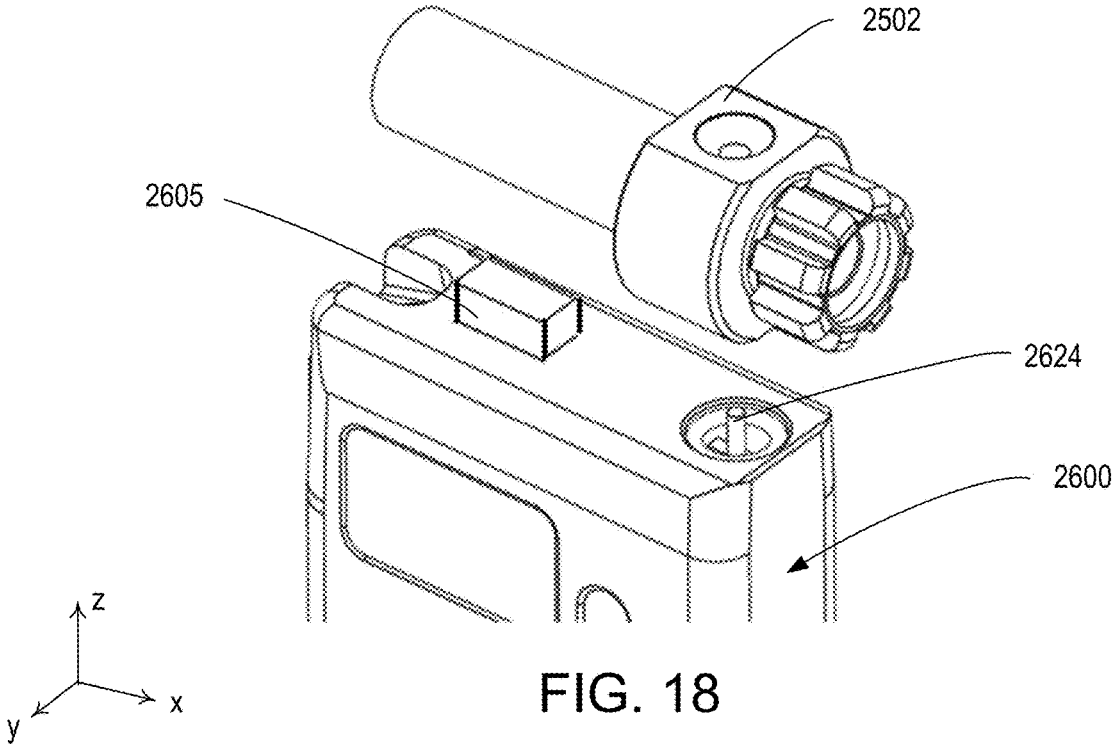
FIG. 18 is a top perspective view of FIG. 17 with the magazine bolt catch activated and the nipple assembly removed to show valve detail.
Figure 19:
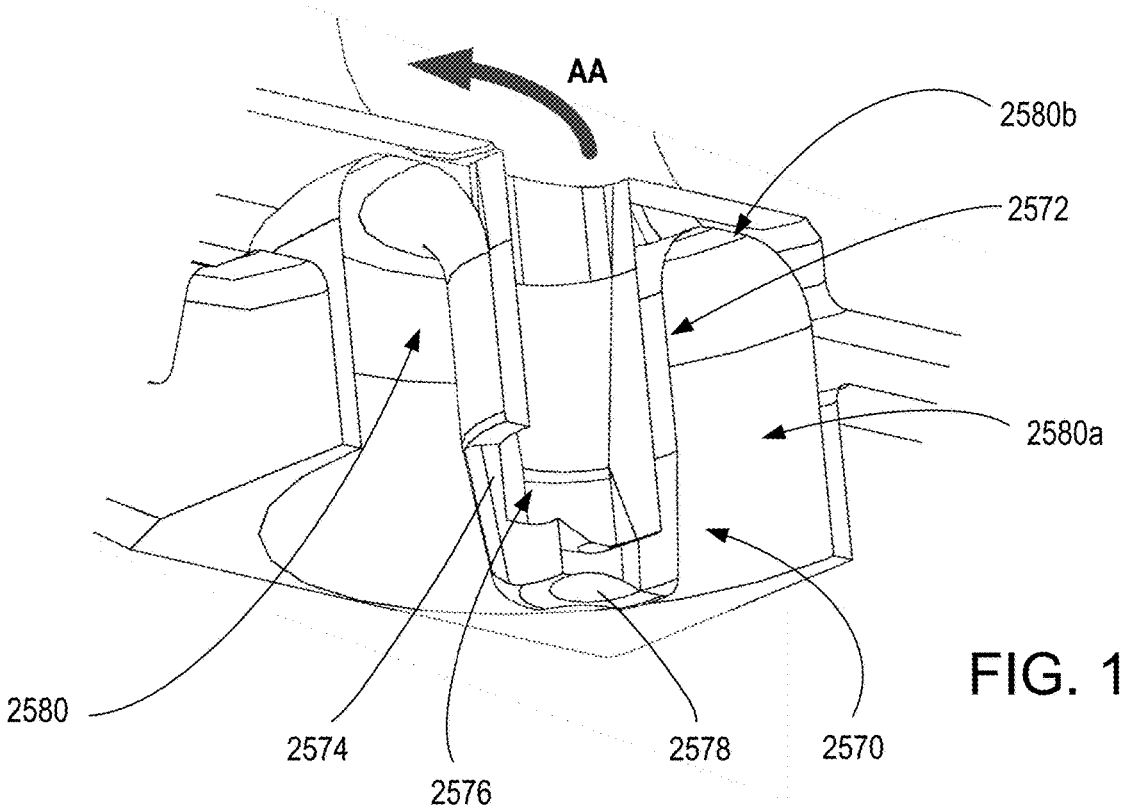
FIG. 19 is an enlarged partial cross-sectional view of the bolt nipple connector taken at the line AA-AA in FIG. 4.

The reciprocating action of the bolt carrier body 2410 can be repeated to simulate the recoil feedback of automatic or semi-automatic fire from the rifle 1000 within which the training weapon system 2000 has been installed. The simulated rounds and reciprocating action of the bolt carrier body 2410 can be repeated until the energy storage system 2610 is depleted or when the energy storage system 2610 reaches a level where it can no longer supply adequate pressure to simulate recoil with the bolt carrier body 2410. The magazine assembly 2600 can be charged or re-pressurized via the access port 2618 (shown in FIG. 8). Alternatively, the spent magazine assembly 2600 can be swapped out by an operator with a new or recharged magazine assembly 2600 for continued use with the training weapon system 2000. In some embodiments, as shown in FIGS. 17 and 18, the magazine assembly 2600 includes a bolt carrier lock 2605. The bolt carrier lock 2605 is configured to deploy from the magazine assembly 2600 and extend into the bolt carrier body 2410 to prevent the bolt carrier body 2410 from advancing forward in the distal direction. The bolt carrier lock 2605 simulates an empty cartridge scenario. In some embodiments, the bolt carrier lock 2605 is deployed when the energy storage system 2610 is depleted or reaches a level where it can no longer supply adequate pressure to simulate recoil. In some embodiments, the bolt carrier lock 2605 is configured to deploy based on a sensed pressure at one or more of the energy storage device 2612, the pressure regulator 2614, or the pressure supply line 2616. In some embodiments, the bolt carrier lock 2605 is electronically controlled.

Variations in tolerance exist between conventional firearms and magazines to promote interoperability and compatibility. For example, the design tolerance between the lower receiver 1220, the magazine 1600, and the magazine catch 1270 can vary from rifle to rifle (even across weapons of the same make and model). However, the additional clearance that results from higher tolerance presents additional challenges for converting the rifle 1000 for use with training systems. As such, a novel system for mounting and aligning a training system to a conventional weapon to accommodate the built in clearance while also provide precision to the training system is desired.

Figure 22:
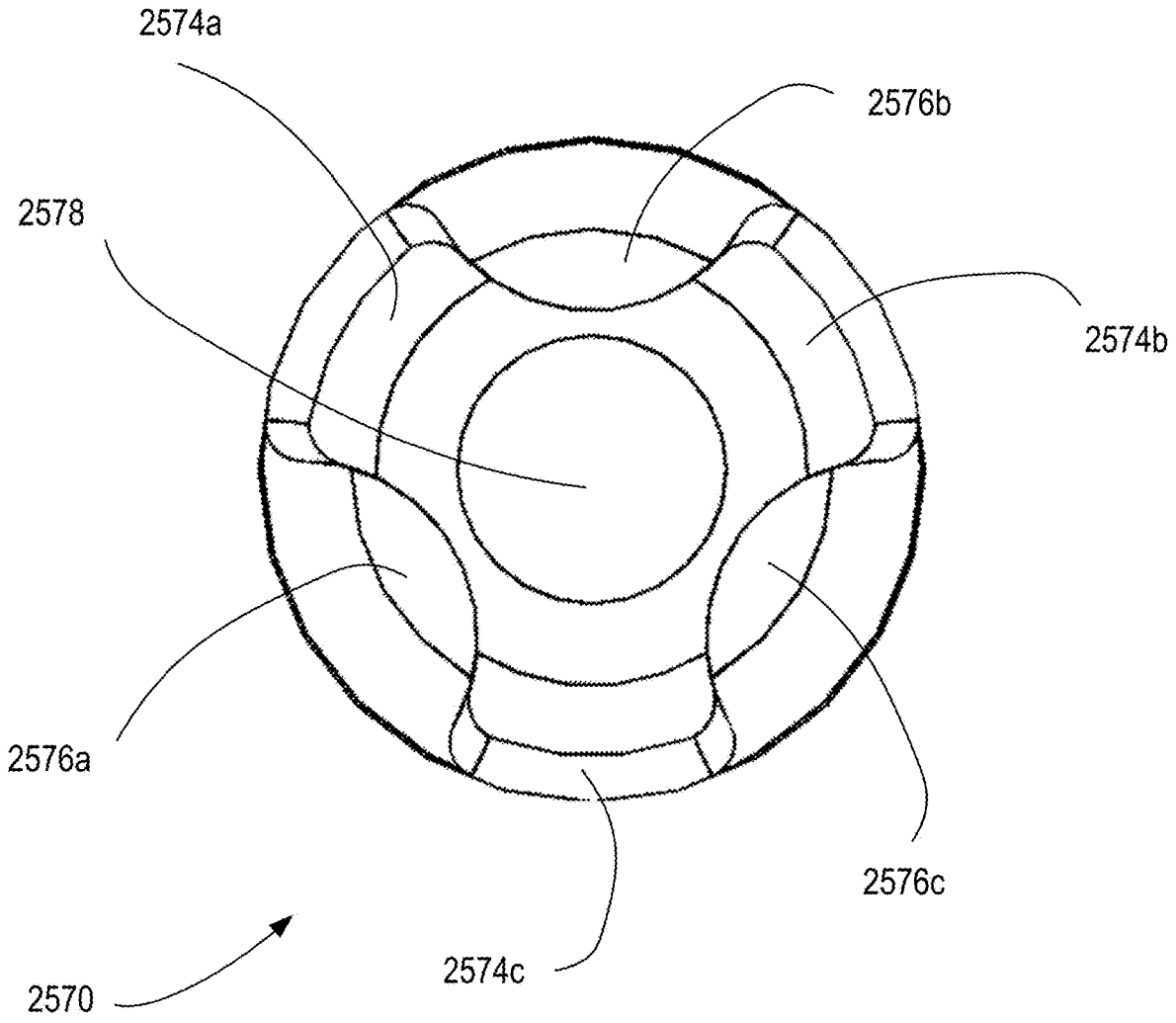
FIG. 22 is a bottom view of the bolt nipple connector of the bolt assembly shown in FIG. 15.

As shown in FIGS. 15-22, the magazine assembly 2600 of the training weapon system 2000 can be quickly attached to and detached from the bolt assembly 2500. The bolt nipple connector 2570 includes a connector body 2572 for interfacing with the nipple assembly 2630 of the magazine assembly 2600. The connector body 2572 extends in a direction perpendicular to the longitudinal axis of the bolt assembly 2500. The bolt nipple connector 2570 further includes a plurality of connector arms 2574 that define one or more connector ports 2576 between each of the connector arms 2574. The bolt nipple connector 2570 further includes an end portion 2578. The end portion 2578 includes a recessed feature for locating and centering the valve actuator pin 2624 of the supply valve 2620 during coupling. In some embodiments, the recessed feature includes a dome-shaped surface. In some embodiments, as shown in FIG. 22, the bolt nipple connector 2570 includes three connector arms 2574*a*, 2574*b*, 2574*c* and includes three connector ports 2576*a*, 2576*b*, 2576*c* defined between the three connector arms 2574*a*, 2574*b*, 2574*c*.

To accommodate for the variation and play that exist in firearms, such as the AR-15 rifle 1000, the bolt assembly 2500 includes a bolt nipple interface 2580. The bolt nipple interface 2580 includes a first contact surface 2580*a* and a second contact surface 2580*b*. The first contact surface 2580*a* is a cylindrical side wall and the second contact surface 2580*b* is an annular end wall with a U-shaped cross section. The first contact surface 2580*a* and the second contact surface 2580*b* are configured to receive and guide the nipple assembly 2630 to the bolt nipple connector 2570 during coupling.

With reference to FIG. 20, the distal portion 2633 of the nipple assembly 2630 includes a rounded lip portion configured to guide the nipple assembly 2630 onto the bolt nipple connector 2570 and into the bolt nipple interface 2580. The rounded lip portion is configured to seat against the second contact surface 2580*b* when the magazine assembly 2600 is coupled to the bolt assembly 2500. The sealing member 2695 is configured to be inserted over the bolt nipple connector 2570. The first seal element 2695*a* of the sealing member 2695 includes a tapered portion to align and guide the seal member 2695 over the distal portion and connector arms 2574 of the bolt nipple connector 2570. The combination of the first seal element 2695*a* and the second seal element 2695*b* accommodates lateral play and offset between the magazine assembly 2600 and the bolt assembly 2500, as discussed above with regards to variations and play, while maintaining an adequate seal between the two components such that a high pressure gas can be supplied via the energy storage system 2610.

With reference to FIGS. 10, 11, and 23-28, the laser targeting system 2700 is configured to be mounted to the distal end portion of the bolt body member 2502. The proximal end portion 2710*a* of the laser body 2710 is at least partially mounted within the bolt body member 2502.

As shown in FIGS. 23 and 24, the distal portion 2710*b* of the laser body 2710 includes an outer surface configured to abut the barrel 1310 of the rifle 1000. The outer surface of the distal portion 2710*b* is configured to abut an interior surface of the barrel 1310 and prevent motion perpendicular to the longitudinal axis of laser body 2710 during operation of the training weapon system 2000.

When an operator pulls the trigger 1215 of the rifle 1000, the hammer 1250 actuates and causes the firing pin 2430 of the bolt carrier assembly 2400 to move in the distal direction, as discussed above. The firing pin 2430 moves the balanced core 2510 in the distal direction. In addition to unseating the bolt cap seal member 2535, the balanced core 2510 applies force against a buffer spring 2550. Because of the sensitivity of the electronics and other components within the laser targeting system 2700, the buffer spring 2550 moderates and buffers the force transferred from the balanced core 2510 to the targeting system 2700. A portion of the force received from the balanced core 2510 is transferred to an actuator pin 2560 of the bolt assembly 2500. The force applied to the actuator pin 2560 causes the actuator pin 2560 to advance in the distal direction relative to the bolt body member 2502. With the laser body 2710 secured to the bolt assembly 2500 via the laser mounting member 2740, distal travel of the actuator pin 2560 depresses the switch 2730 of the laser targeting system 2700. When the switch 2730 is actuated, the laser targeting system 2700 emits a beam of laser via the laser output 2720. The emitted laser can be used to simulate a shot being fired from the rifle 1000 and a compatible training system can be used to detect whether the emitted laser reached an intended target signifying a hit.

Figure 26:
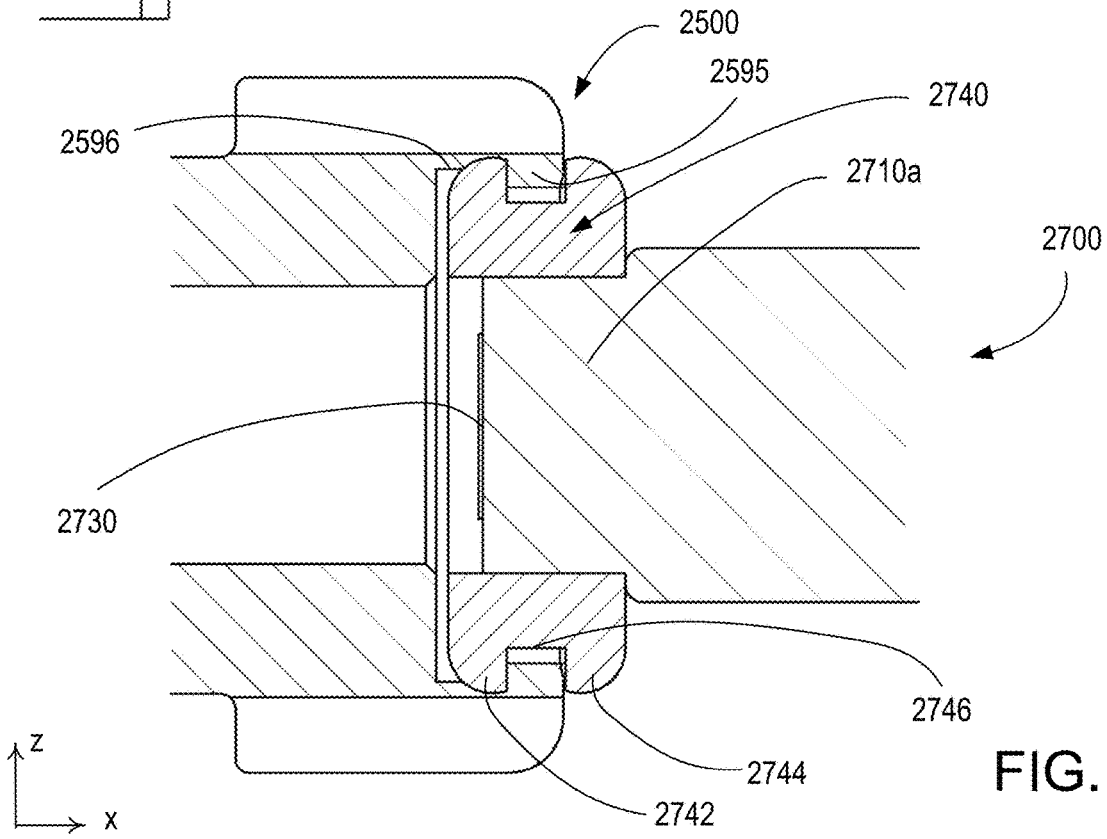
FIG. 26 is a cross sectional view of the mounting member of FIG. 24.

The laser targeting system 2700 further includes a laser mounting member 2740 to secure the proximal end portion 2710*a* to the bolt body member 2502. The laser mounting member 2740 is a floating mounting member configured to absorb lateral and/or axial input forces. For example, as shown in FIGS. 25 and 26, the laser mounting member 2740 is a grommet including a first annular lip 2742 and a second annular lip 2744. The first annular lip 2742 and the second annular lip 2744 are spaced axially along the longitudinal axis of the laser body 2710. The laser mounting member 2740 includes a recess 2746 defined between the first annular lip 2742 and the second annular lip 2744. The first annular lip 2742 includes a first outer diameter, and the second annular lip 2744 includes a second outer diameter. In some embodiments, each of the first annular lip 2742 and the second annular lip 2744 have a diameter greater than about 1.27 cm (0.5 inches). In some embodiments, each of the first annular lip 2742 and the second annular lip 2744 have a diameter of between about 1.27 cm (0.5 inches) and 1.905 cm (0.75 inches). While the first and second outer diameters are depicted as being equal in size, the first and second diameters can be different sizes. As shown in FIG. 26, the bolt assembly 2500 includes a bolt laser interface 2595 and a bolt laser interface groove 2956. The bolt laser interface 2595 includes an interface inner diameter and the bolt laser interface groove 2596 includes a groove inner diameter, the groove inner diameter being greater than the interface inner diameter. In some embodiments, the interface inner diameter is about 1.397 cm (0.55 inches) and the groove inner diameter is about 1.27 cm (0.5 inches). The bolt laser interface 2595 is configured to engage and seat within the recess 2746 of the laser mounting member 2740. The bolt laser interface groove 2956 is configured to receive the first annular lip 2742 of the laser mounting member 2740.

The laser mounting member 2740 includes an internal surface configured to receive the proximal end of the laser body 2710. In a relaxed state, the internal surface of the laser mounting member 2740 defines a first inner diameter. In some embodiments, the first inner diameter of the laser mounting member 2740 is less than about 0.79375 cm (0.3125 inches). The proximal end of the laser body 2710*a* defines an outer diameter, the outer diameter being greater than the first inner diameter of the laser mounting member 2740. The internal surface of the laser mounting member 2740 is configured to expand to a second inner diameter to accommodate and secure the laser body 2710. In some embodiments, the second outer diameter is greater than the first outer diameter. The laser mounting member 2470 is made of an elastomeric material. In some embodiments, the laser mounting member 2470 is a rubber grommet. The laser mounting member 2470 is configured to accommodate misalignment of one or more of the barrel 1310, the bolt assembly 2500, and the laser targeting system 2700. Furthermore, because of the sensitive electronic components within the laser targeting system 2700, the laser mounting members 2470 absorbs shock to prevent damage to the laser targeting system 2700. The laser mounting member 2470 further enables the laser targeting system 2700 to be quickly decoupled from or installed onto the bolt assembly 2500 when both the laser target system 2700 and the bolt assembly 2500 are removed from the rifle 1000. This allows the laser target system 2700 to be quickly and easily separated from the bolt assembly 2500 for servicing and inspection.

Figure 27:
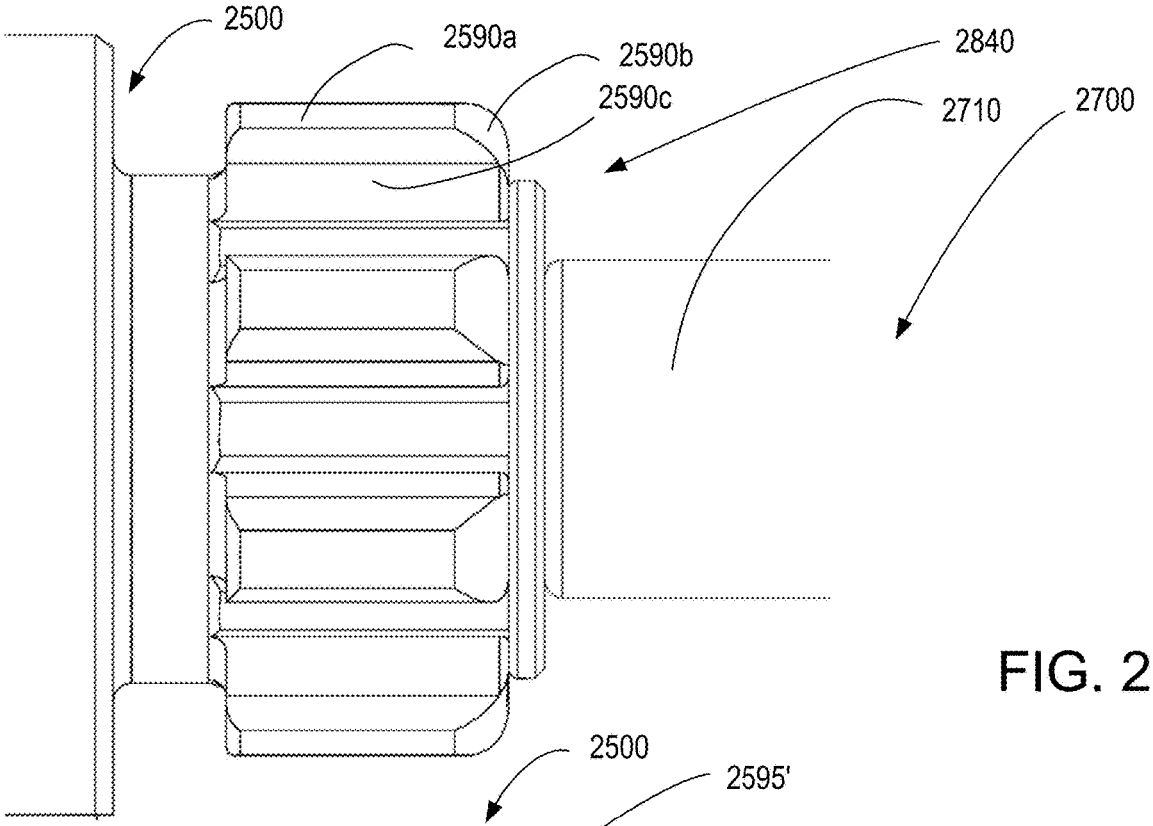
FIG. 27 is a side view of the mounting member between the bolt assembly and the laser assembly of the training weapon system according to an embodiment.
Figure 28:
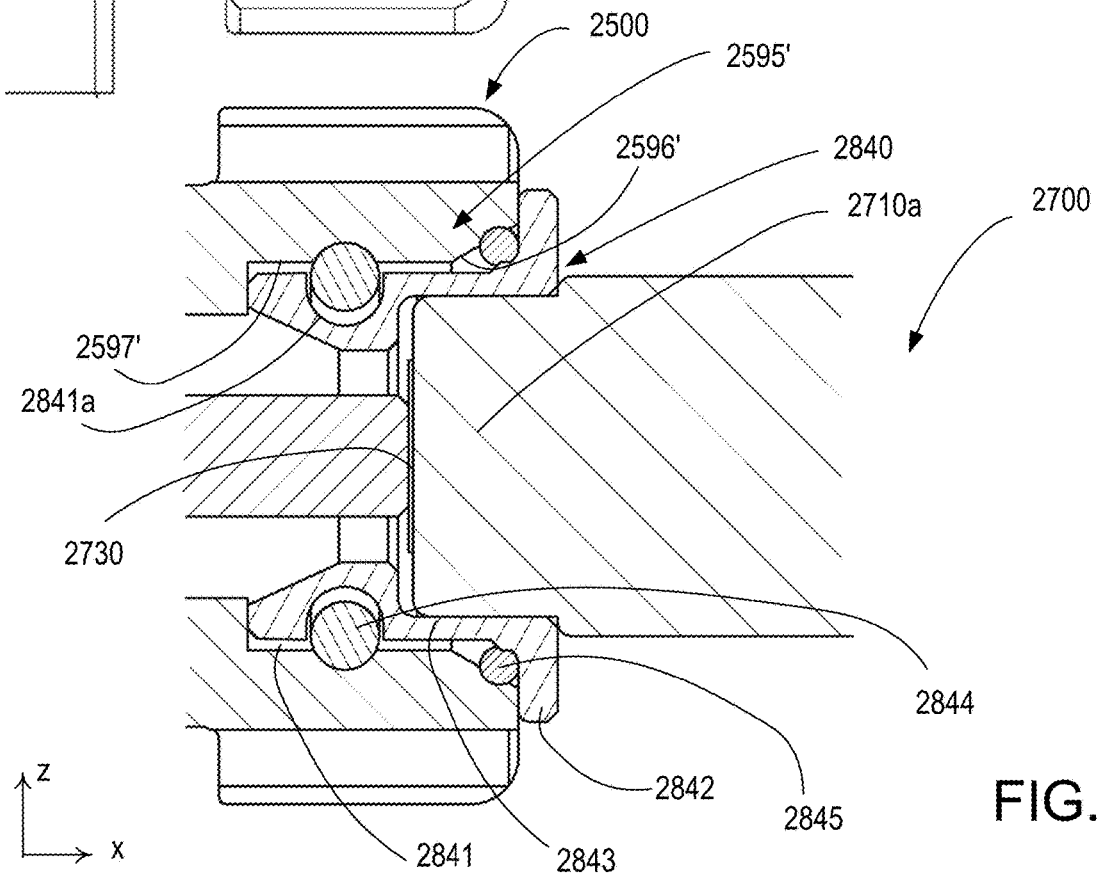
FIG. 28 is a cross sectional view of the mounting member of FIG. 27.

In some embodiments, as shown in FIGS. 27 and 28, the distal end portion of the bolt body member 2502 can include a bolt laser interface 2595' with a first seal surface 2956' and a second seal surface 2957'. The bolt laser interface 2595' is configured to receive a laser mounting member 2840, which may be in the form of a cap. The second seal surface 2957' extends at an angle relative to the first seal surface 2956'. In some embodiments, the second seal surface 2957' extends at an angle of between about 15 degrees and 75 degrees. In some embodiments, the second seal surface 2957' extends at an angle of between about 30 degrees and 45 degrees. The second seal surface 2957' defines a minimum inner diameter, and the minimum inner diameter is greater than or equal to an inner diameter of the first seal surface 2955'. In some embodiments, the inner diameter of the first seal surface 2955' is between about 0.762 cm (0.3 inches) to about 1.27 cm (0.5 inches). In some embodiments, the inner diameter of the first seal surface 2955' is between about 1.016 cm (0.4 inches).

The laser mounting member 2840 includes an outer surface 2841, an end stop portion 2842, and an internal surface 2843. The outer surface 2841 is configured to be inserted into the bolt laser interface 2595'. The outer surface 2841 of the laser mounting member is configured to support one or more sealing members, such as O-ring members. The outer surface 2841 includes a recess 2841*a* configured to retain a first sealing member 2844 at a first location. The end stop portion 2842 limits movement of a second sealing member 2845 on the outer surface 2841 at a second location. The second location is different from the first location. In some embodiments, the first sealing member 2844 is thicker than the second sealing member 2845. Stated in a different manner, a radius of the tube forming the first sealing member 2844 is greater than a radius of the tube forming the second sealing member 2845. In some embodiments, an outer radius of the first sealing member 2844 extending from a central axis of the first sealing member 2844 is greater than an outer radius of the second sealing member 2845 extending from a central axis of the second sealing member 2845.

In some embodiments, when the laser mounting member 2840 is inserted into the bolt body member 2502, the first seal member 2844 is configured to contact the first seal surface 2956' and the second seal member 2845 is configured to contact the second seal surface 2957'. The end stop portion 2842 is configured to abut against a distal end surface 2503 of the bolt body member 2502. An outer diameter of the end stop portion 2842 is greater than a maximum inner diameter of the second seal surface 2957'

In some embodiments, the laser mounting member 2480 is made of one or more of a polymer, composite, and/or metallic material. The laser mounting member 2480 is configured to accommodate misalignment of one or more of the barrel 1310, the bolt assembly 2500, and the laser targeting system 2700. Furthermore, because of the sensitive electronic components within the laser targeting system 2700, the laser mounting member 2480 absorbs shock, via the one or more seal members 2844, 2845 to prevent damage to the laser targeting system 2700. The laser mounting member 2480 further enables the laser targeting system 2700 to be quickly decoupled from or installed onto the bolt assembly 2500 when both the laser target system 2700 and the bolt assembly 2500 are removed from the rifle 1000. This allows the laser target system 2700 to be quickly and easily separated from the bolt assembly 2500 for servicing and inspection.

The training weapon system 2000 (or any other training weapon systems described herein) can be used to perform any of the methods described herein, such as the method 3000 of installing the training weapon system 2000 (see FIG. 29) and/or the method of 4000 of generating a simulated round in a firearm using the training weapon system 2000 (see FIG. 30), as described below.

Figure 29:
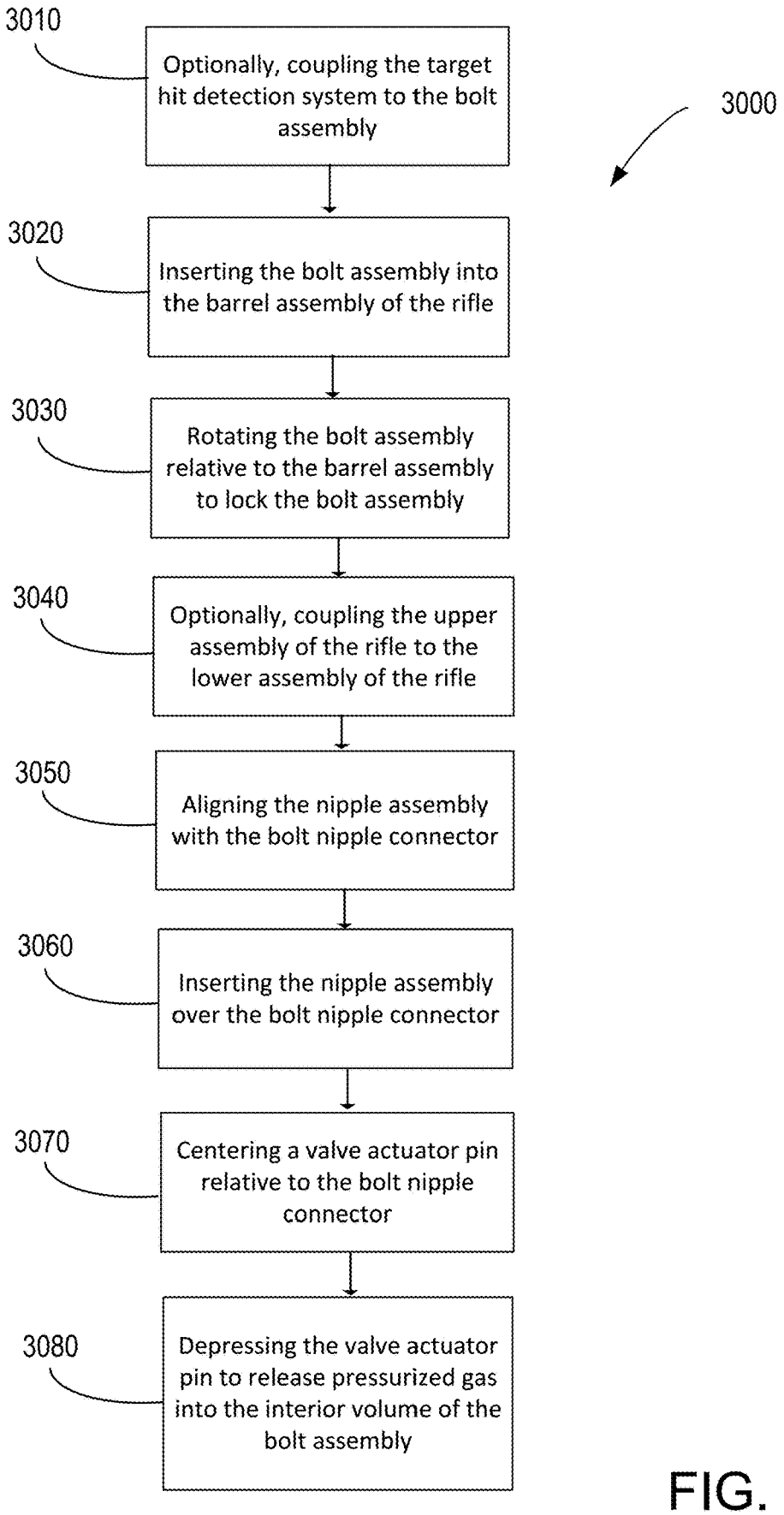
FIG. 29 is a flow diagram of a method of installing a training weapon on a firearm according to an embodiment.

In some embodiments, the training weapon system 2000 can be installed in a firearm, such as AR-15 rifle 1000. For example, FIG. 29 is a flow chart showing a method 3000 of installing the training weapon system 2000 into the rifle 1000. Although the method is described with reference to the training weapon system 2000 and the rifle 1000, the method can be performed using other training weapons systems described herein and other related rifles and firearms. The method 3000 includes optionally coupling a target hit detection system 2700 (also referred to as a laser targeting system) to a bolt assembly 2500, at 3010. The method 3000 further includes inserting the bolt assembly 2500 into the barrel assembly 1300 of the rifle 1000, at 3020. The method 3000 includes rotating the bolt assembly 2500 relative to the barrel assembly 1300 of the rifle 1000 to lock the bolt assembly 2500 within the barrel assembly 1300, at 3030. In some embodiments, the rotating can be performed manually by hand without any tools. The method 3000 includes coupling the upper assembly 1100 to the lower assembly 1200 of the rifle, at 3040.

The method 3000 includes coupling the magazine assembly 2600 to the bolt assembly 2500. In some embodiments, the coupling of the magazine assembly 2600 includes aligning the nipple assembly 2630 of the magazine assembly 2600 with the bolt nipple connector 2570 of the bolt assembly 2500, at 3050. In some embodiments, the coupling of the magazine assembly 2600 further includes inserting the nipple assembly 2630 over the bolt nipple connector 2570, at 3060. In some embodiments, the coupling of the magazine assembly 2600 further includes centering a valve actuator pin 2624 relative to the bolt nipple connector 2570, at 3070. In some embodiments, the coupling of the magazine assembly 2600 includes depressing the valve actuator pin 2624 to release a pressurized gas from the magazine assembly into the bolt assembly 2500 upon completion of the attachment of the magazine assembly 2600 to the bolt assembly 2500, at 3080.

Figure 30:
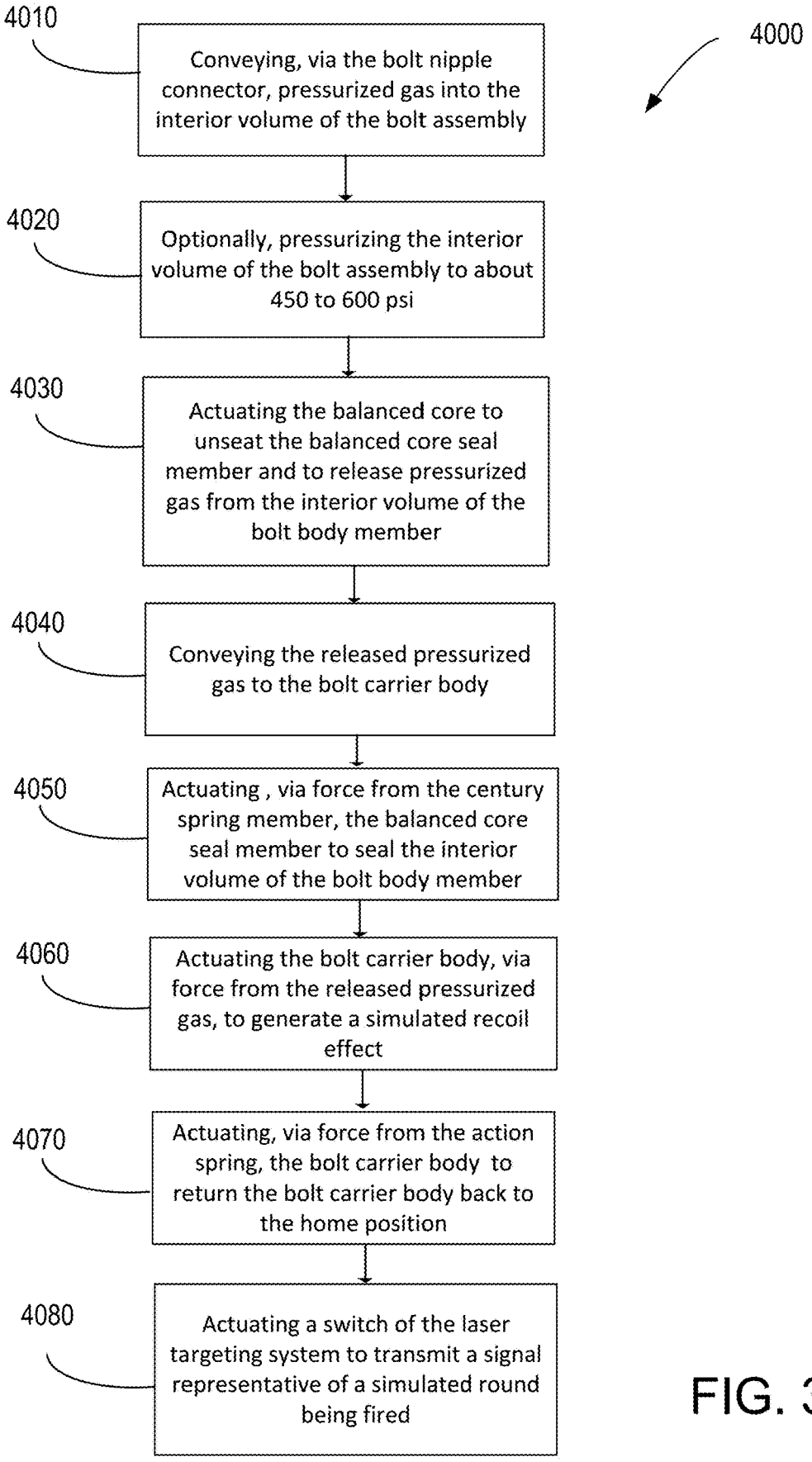
FIG. 30 is a flow diagram of a method of generating a simulated round in a firearm using a training weapon system according to an embodiment.

In some embodiments, the training weapon system 2000 can be operated to simulate firing of an ammunition round. For example, FIG. 30 is a flow chart showing a method 4000 of operating the training weapon system 2000 to simulate recoil and to trigger a laser targeting system. Although the method is described with reference to the training weapon system 2000 and the rifle 1000, the method can be performed using other training weapons systems described herein and other related rifles and firearms. The method 4000 includes conveying, via the bolt nipple connector 2570, pressurized gas into the interior volume of the bolt body member 2502 of the bolt assembly 2500, at 4010. Optionally, the conveying pressurized gas includes pressurizing the interior volume of the bolt body member 2502 to a pressure of between about 3102.6 kPa (450 psi) to 4136.9 kPa (600 psi), at 4020. The method 4000 includes actuating the balanced core 2510 to unseat the balanced core seal member 2515 from the bolt cap 2530, thereby releasing pressurized gas from the interior volume of the bolt body member 2502, at 4030. In some embodiments, the actuating the balanced core 2510 includes moving the balanced core 2510 in the distal direction (i.e., towards the muzzle 1320 of the rifle 1000). The method 4000 includes conveying the released pressurized gas from the interior volume of the bolt body member 2502 to the bolt carrier body 2410, at 4040. The method 4000 includes actuating, via force from the spring member 2540, the balanced core 2510 in the proximal direction (i.e., away from the muzzle 1320 of the rifle 1000) to seat the balanced core seal member 2515 back on the bolt cap 2530, and as a result fluidically sealing the interior volume of the bolt body member 2502, at 4050.

The method 4000 includes actuating, via force from the released pressurized gas, the bolt carrier body 2410 in the proximal direction to simulate recoil resulting to a live ammunition round, at 4060. The method 4000 includes actuating, via force from the action spring 1230, the bolt carrier body 2410 in the distal direction to return the bolt carrier body 2410 back to the home position, at 4070. The method 4000 includes actuating a switch of the laser targeting system 2700 to transmit a signal representative of a simulated round being fired from the firearm, at 4080.

Although the steps of associated with the installation method 3000 and the operating method 4000 are shown and described in a particular order, the sequencing of the steps may be rearranged and/or the steps can be performed concurrently, as will be appreciated to one skilled in the art in view of the present disclosure.

Although various embodiments have been described as having particular features and/or combinations of components, other embodiments are possible having a combination of any features and/or components from any of embodiments where appropriate.

What is claimed is:

1. An apparatus, comprising:

a bolt carrier assembly;

a bolt assembly, the bolt assembly being coupled to the bolt carrier assembly, wherein:

the bolt assembly includes a bolt body member, the bolt body member having a proximal end portion and a distal end portion, and the bolt body member defining a longitudinal axis extending from the proximal end portion to the distal end portion, the bolt assembly includes a guide member attached to proximal end portion, the guide member being parallel to the longitudinal axis, and the bolt assembly includes a bolt chamber interface attached to the distal end portion, the bolt chamber interface being configured to nest within an interior wall of a firearm chamber, and the bolt chamber interface being configured to limit rotational and axial movement of the bolt assembly relative to the firearm chamber; and a magazine assembly, the magazine assembly including a nipple assembly, wherein:

the nipple assembly includes a proximal portion and a distal portion, the distal portion includes a recess configured to retain a first sealing member, the first sealing member extending radially inward relative to the nipple assembly, the first sealing member includes a first seal element and a second seal element, the first seal element at least partially surrounds the second seal element, proximal portion includes a recess configured to retain a second sealing member, and the second sealing member extending radially outward relative to the nipple assembly.

2. The apparatus of claim 1, wherein the bolt assembly includes a bolt nipple connector for mating with the nipple assembly of the magazine assembly.

3. The apparatus of claim 2, wherein:

the bolt body member defines an interior volume for retaining pressurized gas; and the interior volume is configured to receive pressurized gas from the magazine assembly via the bolt nipple connector.

4. The apparatus of claim 3, wherein:

the bolt assembly includes a balanced core; and the balanced core is configured to actuate to unseat a balanced core seal member to release pressurized gas from the interior volume of the bolt body member.

5. The apparatus of claim 1, wherein the bolt carrier assembly includes a bolt carrier body and a guide member receiver extending through at least a portion of the bolt carrier body, the bolt carrier body being configured to slide relative to the bolt assembly.

6. The apparatus of claim 5, wherein the bolt carrier body is slidable along the guide member via the guide member receiver in a direction parallel to the longitudinal axis.

7. The apparatus of claim 1, further comprising a target hit detection system.

8. The apparatus of claim 7, wherein the target hit detection system is a laser targeting system.

9. The apparatus of claim 8, wherein:

the laser targeting system comprises a laser body, the laser body having a proximal end portion and a distal end portion;

the laser targeting system includes a laser output at the distal end portion; and the laser targeting system includes a switch at the proximal end portion.

10. The apparatus of claim 9, wherein the bolt assembly includes a buffer spring member and an actuator pin, the actuator pin being configured to depress the switch of the laser targeting system when actuated.

11. The apparatus of claim 1, further comprising a mount configured to secure a laser targeting system to the distal end portion of the bolt body member.

12. An apparatus, comprising:

a bolt assembly; and a targeting system mount coupled to the bolt assembly, wherein:

the bolt assembly includes a bolt body member, the bolt body member having a proximal end portion and a distal end portion, and the bolt body member defining a longitudinal axis extending from the proximal end portion to the distal end portion, the bolt assembly includes a bolt chamber interface attached to the distal end portion, the bolt chamber interface being configured to nest within an interior wall of a firearm chamber, and the bolt chamber interface being configured to limit rotational and axial movement of the bolt assembly relative to the firearm chamber, and the target system mount is configured to secure a laser targeting system to the distal end portion of the bolt body member, the target system mount includes a grommet that includes a first annular lip and a second annular lip, the first annular lip and the second annular lip are spaced axially apart along a longitudinal axis of the grommet, and the first annular lip and the second annular lip are configured to interlock with the distal end portion of the bolt body member.

13. An apparatus comprising:

a bolt assembly, the bolt assembly including a bolt body member and a bolt chamber interface, the bolt body member having a proximal end portion and a distal end portion, and the bolt body member and defining a longitudinal axis extending from the proximal end portion to the distal end portion, the bolt chamber interface is attached to the distal end portion and is configured to nest within an interior wall of a firearm chamber and to limit rotational and axial movement of the bolt assembly relative to the firearm chamber; and a targeting system mount coupled to the bolt assembly and configured to secure a laser targeting system to the distal end portion of the bolt body member, the target system mount is a cap including an outer surface and an end stop portion, the end stop portion being configured to abut against the distal end portion of the bolt body member while the outer surface is inserted within the distal end portion of the bolt body member.

14. The apparatus of claim 11, wherein the mount is a grommet including a first annular lip and a second annular lip, the first annular lip and the second annular lip being spaced axially apart along a longitudinal axis of the grommet, and the first annular lip and the second annular lip being configured to interlock with the distal end portion of the bolt body member.

15. The apparatus of claim 11, wherein the mount is a cap including an outer surface and an end stop portion, the end stop portion being configured to abut against the distal end portion of the bolt body member while the outer surface is inserted within the distal end portion of the bolt body member.

16. The apparatus of claim 12, wherein the bolt chamber interface includes a plurality of bolt lugs dimensioned to interlock with corresponding lugs of a firearm barrel.

17. The apparatus of claim 12, wherein:

the bolt body member defines an interior volume for retaining pressurized gas; and the interior volume is configured to receive pressurized gas from a magazine assembly via a bolt nipple connector.

18. The apparatus of claim 17, wherein:

the bolt assembly includes a balanced core; and the balanced core is configured to actuate to unseat a balanced core seal member to release pressurized gas from the interior volume of the bolt body member.

19. The apparatus of claim 13, wherein the bolt chamber interface includes a plurality of bolt lugs dimensioned to interlock with corresponding lugs of a firearm barrel.

20. The apparatus of claim 13, wherein:

the bolt body member defines an interior volume for retaining pressurized gas;

the interior volume is configured to receive pressurized gas from a magazine assembly via a bolt nipple connector;

the bolt assembly includes a balanced core; and the balanced core is configured to actuate to unseat a balanced core seal member to release pressurized gas from the interior volume of the bolt body member.

* * * * *